US011173678B2

(12) United States Patent
Walsh et al.

(10) Patent No.: US 11,173,678 B2
(45) Date of Patent: Nov. 16, 2021

(54) COMPACTOR

(71) Applicants: James Walsh, Dublin (IE); Therese Walsh, Dublin (IE)

(72) Inventors: James Walsh, Blackrock (IE); William Cregan, Dublin (IE)

(73) Assignees: James Walsh, Dublin (IE); Therese Walsh, Dublin (IE)

( * ) Notice: Subject to any disclaimer, the term of this patent is extended or adjusted under 35 U.S.C. 154(b) by 119 days.

(21) Appl. No.: 16/324,054

(22) PCT Filed: Aug. 3, 2017

(86) PCT No.: PCT/EP2017/069673
§ 371 (c)(1),
(2) Date: Feb. 7, 2019

(87) PCT Pub. No.: WO2018/029079
PCT Pub. Date: Feb. 15, 2018

(65) Prior Publication Data

US 2019/0193361 A1 Jun. 27, 2019

(30) Foreign Application Priority Data

Aug. 9, 2016 (EP) ..... 16183472

(51) Int. Cl.

| | |
|---|---|
| ***B30B 9/30*** | (2006.01) |
| ***B30B 15/28*** | (2006.01) |
| ***B65B 57/00*** | (2006.01) |
| ***B65B 63/02*** | (2006.01) |

(52) U.S. Cl.
CPC ..... *B30B 9/3032* (2013.01); *B30B 9/3007* (2013.01); *B30B 9/3042* (2013.01);
(Continued)

(58) Field of Classification Search
CPC ..... B30B 9/3007; B30B 9/3032; B30B 9/3042; B30B 15/28; B30B 9/3021; B30B 7/04; B65B 57/00; B65B 63/02; B65F 1/1405
(Continued)

(56) References Cited

U.S. PATENT DOCUMENTS 3,541,949 A * 11/1970 Milton ..... B30B 15/08 100/49
3,708,953 A * 1/1973 Aluotto ..... B65B 63/02 53/527
(Continued)

FOREIGN PATENT DOCUMENTS

CA 2 299 708 A1 8/2001
CN 201 828 502 U 5/2011
(Continued)

OTHER PUBLICATIONS

International Search Report issued in PCT/EP2017/069673; dated Mar. 8, 2018.

*Primary Examiner* — Matthew Katcoff
*Assistant Examiner* — Smith Oberto Bapthelus
(74) *Attorney, Agent, or Firm* — Studebaker & Brackett PC

(57) ABSTRACT

A compactor has a plunger housing with a door for insertion of waste. The plunger presses waste into a bag on a pallet within an enclosure with panels and a pair of panels in the form of doors at the rear. Side panels, are joined along their lower edges to a floor panel, the side panels supporting the end panels at vertical hinges. There is resilience due to the ability of the various panels to move, in which each side panel is cantilevered about the corner at which it is joined to the floor panel, and the end panels can rotate about the relevant vertical axis of the hinges. As the plunger presses
(Continued)

axially to compact waste within a bag when the bag approaches being full.

10 Claims, 17 Drawing Sheets

(52) U.S. Cl.
CPC ..... *B30B 15/28* (2013.01); *B65B 57/00* (2013.01); *B65B 63/02* (2013.01)

(58) Field of Classification Search
USPC ..... 100/59
See application file for complete search history.

(56) References Cited

U.S. PATENT DOCUMENTS 3,734,340 A 5/1973 Ippolito et al.
3,802,335 A * 4/1974 Longo ..... B30B 9/3007 100/35
4,817,824 A 4/1989 LaFleur et al.
5,682,929 A 11/1997 Maginot et al.
9,751,118 B2 * 9/2017 McLaughlin ..... B30B 15/281

FOREIGN PATENT DOCUMENTS

DE 20 03 483 A1 8/1971
DE 32 09 688 A1 9/1983
DE 42 07 025 A1 9/1993
DE 42 38 498 A1 6/1994
DE 44 00 362 A1 7/1995
EP 2 251 189 A2 11/2010
EP 2251189 A2 * 11/2010 ..... B30B 9/3042
FR 2 999 162 A1 6/2014
GB 1285097 * 8/1970
GB 1 285 097 A 8/1972
WO 03/006314 A1 1/2003

* cited by examiner

STAGE 6

Energy vs. pressure

The energy will dissipate at a quicker rate than the pressure / force in the hydraulic system

COMPACTOR

FIELD OF THE INVENTION

The invention relates to waste compactors.

PRIOR ART DISCUSSION

It is known to provide a waste compactor which has a plunger or "press" which presses waste material into a large heavy-duty compactor bag. In order to withstand the forces arising from the piston operation it is necessary to provide a compactor bag of high strength reinforced construction. Such bags are expensive, and bulky to store before use.

The present invention is directed towards providing a compactor in which:

- a bag of less strength can be used, and/or
- there is a lower overall height and/or lateral dimension, and/or
- it is of simpler and less expensive construction and/or
- much less power input is required.

SUMMARY OF THE INVENTION

According to the invention, there is provided a compactor comprising a compacting press driven by an actuator to press material into a bag, wherein the compactor comprises an enclosure for forming a structure to contain the bag during material compaction, wherein the enclosure has parts which may be opened to insert or remove a bag.

In one embodiment, the enclosure comprises one or more panels. In one embodiment, rein the enclosure comprises at least one mesh panel.

In one embodiment, the enclosure includes a wall for receiving a pallet onto which a bag within the enclosure rests in use. In one embodiment, the enclosure has a removable rim around an enclosure opening to receive a housing for the compacting press. In one embodiment, the rim has a movable wall to allow removal by extraction such as by sliding of the enclosure from the compacting press housing.

In one embodiment, the wall is pivotable and comprises a user handle. In one embodiment, the handle extends around the compacting press housing.

In one embodiment, the actuator comprises opposed rams for reduction of length of the compacting press housing. In one embodiment, the compacting press housing is vertically arranged.

In one embodiment, the actuator comprises a support frame having a stem parallel to the rams, and a cross-piece at each end of the stem, each cross piece engaging at least one ram and at least some of the cross-pieces being mutually orthogonal.

In one embodiment, each cross piece engages two rams. In one embodiment, each cross-piece engages at least one ram cylinder.

In one embodiment, the enclosure comprises a pallet anchor to restrict a pallet from moving during a compaction cycle and during transport. In one embodiment, the enclosure includes a plurality of resilient panels which have at least one free edge and are mounted for deflecting about one or more fixed edge under pressure applied by force of material in the bag.

Preferably, at least one resilient panel has a single fixed edge for said deflection, and preferably each said panel is rectangular with three free edges and a single fixed edge.

In one embodiment, the enclosure resilient panels include at least one side panel extending substantially in the axial direction. In one embodiment, the enclosure resilient panels include a pair of opposed resilient side panels extending substantially in the axial direction on opposed sides of the press longitudinal axis.

In one embodiment, said resilient panels are interconnected by a transverse panel extending between the side panels and joined to them along side edges, whereby the side panels are arranged to deflect about a joint with said transverse panel.

In one embodiment, the transverse panel is configured to support the bag in use.

In one embodiment, the enclosure includes at least one distal panel extending in a plane across the longitudinal axis, said distal panel or panels forming a distal wall of the enclosure.

In one embodiment, the or each distal panel is hinged and can open to allow removal of a filled bag. In one embodiment, there are two distal panels, each hinged to a side panel and arranged to be releasably engaged with an opposed hinged distal panel along a free edge.

In one embodiment, the enclosure includes an open side facing the actuator and an additional open side parallel to the longitudinal axis.

In one embodiment, the enclosure comprises resilient panels interconnected by a transverse panel extending between the side panels and joined to them along side edges, whereby the side panels are arranged to deflect about a joint with said transverse panel, the transverse panel is configured to support the bag in use, and wherein the open side is opposed to said transverse panel.

In one embodiment, the compactor further comprises a controller and at least one sensor arranged to detect a parameter of physical movement of the enclosure or a bag, and the controller is configured to dynamically adjust parameters for applying power to the compacting press in response to said detected parameter values.

Preferably, the enclosure comprises panels mounted to deflect about an axis and sensors arranged to detect extent of deflection about the axis.

In one embodiment, the controller is configured to dynamically reduce compacting press stroke length and/or applied pressure in response to sensing of panel deflection above a threshold, In one embodiment, the enclosure is open on at least one side and the sensors include a senor to detect extent of bulging of an exposed flexible wall of a bag, and the controller is configured to reduce compacting press stroke length and/or applied pressure in response to detection of said bulging above a threshold.

In one embodiment, the controller is configured to store said parameter values or meta data derived from said values to generate a model for filling of an enclosure, and to refer to said model for real time control in the future.

In another aspect, we describe a method of operation of a compactor comprising:

- a compacting press driven by an actuator to press material into a bag,
- an enclosure for forming a structure to contain the bag during material compaction, wherein the enclosure has parts which may be opened to insert or remove a bag, and
- a controller and at least one sensor arranged to detect a parameter of physical movement of the enclosure or a bag,
- the method comprising the controller dynamically adjusting parameters for operation of the compacting press in response to said detected parameter values.

In one embodiment, the enclosure comprises panels mounted to deflect about an axis and sensors to detect extent of said deflection.

In one embodiment, the controller dynamically reduces compacting press stroke length in response to sensing of panel deflection above a threshold, In one embodiment, the enclosure is open on at least one side and the sensors include a senor to detect extent of bulging of an exposed flexible wall of a bag, and the controller reduces compacting press stroke length in response to detection of said bulging above a threshold.

In one embodiment, the controller stores said parameter values or meta data derived from said values to generate a model for filling of an enclosure, and refers to said model for real time control in the future.

Additional Statements

According to the invention, there is provided a compactor comprising a compacting press driven by an actuator to press material into a bag, wherein the compactor comprises an enclosure for forming a structure to contain the bag during material compaction.

In one embodiment, the enclosure has at least one mesh wall. In one embodiment, the enclosure is in the form of a cage.

In one embodiment, the enclosure comprises one or more planar walls.

In one embodiment, the enclosure has parts which may be opened about a hinge to insert or remove a bag.

In one embodiment, the enclosure includes a lower compartment for receiving a pallet onto which a bag within the enclosure rests in use.

In one embodiment, the enclosure has a removable rim around an enclosure opening to receive a housing for the compacting press. In one embodiment, the rim has a movable wall to allow removal by extraction such as by sliding of the enclosure from the compacting press housing.

In one embodiment, the wall is pivotable and comprises a user handle. In one embodiment, the handle extends around the compacting press housing.

In one embodiment, the actuator comprises opposed rams for reduction of length of the compacting press housing. In one embodiment, the compacting press housing is vertically arranged.

In one embodiment, the actuator comprises a support frame having a stem parallel to the rams, and a cross-piece at each end of the stem, each cross piece engaging at least one ram and at least some of the cross-pieces being mutually orthogonal. In one embodiment, each cross piece engages two rams. In one embodiment, each cross-piece engages at least one ram cylinder.

In one embodiment, the enclosure comprises a pallet anchor to restrict a pallet from moving during a compaction cycle and during transport.

DETAILED DESCRIPTION OF THE INVENTION

BRIEF DESCRIPTION OF THE DRAWINGS

The invention will be more clearly understood from the following description of some embodiments thereof, given by way of example only with reference to the accompanying drawings in which.

DESCRIPTION OF THE EMBODIMENTS

Vertical Compactor

Figure 1:
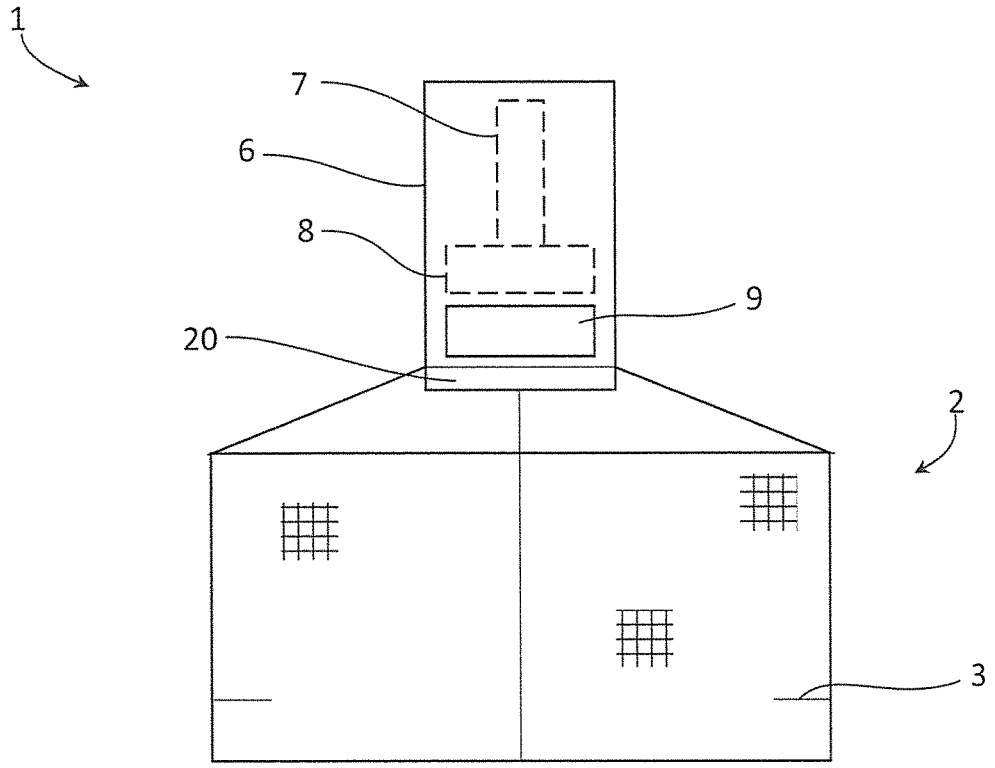
FIG. 1 is a front view of a waste compactor of the invention of one embodiment.
Figure 2:
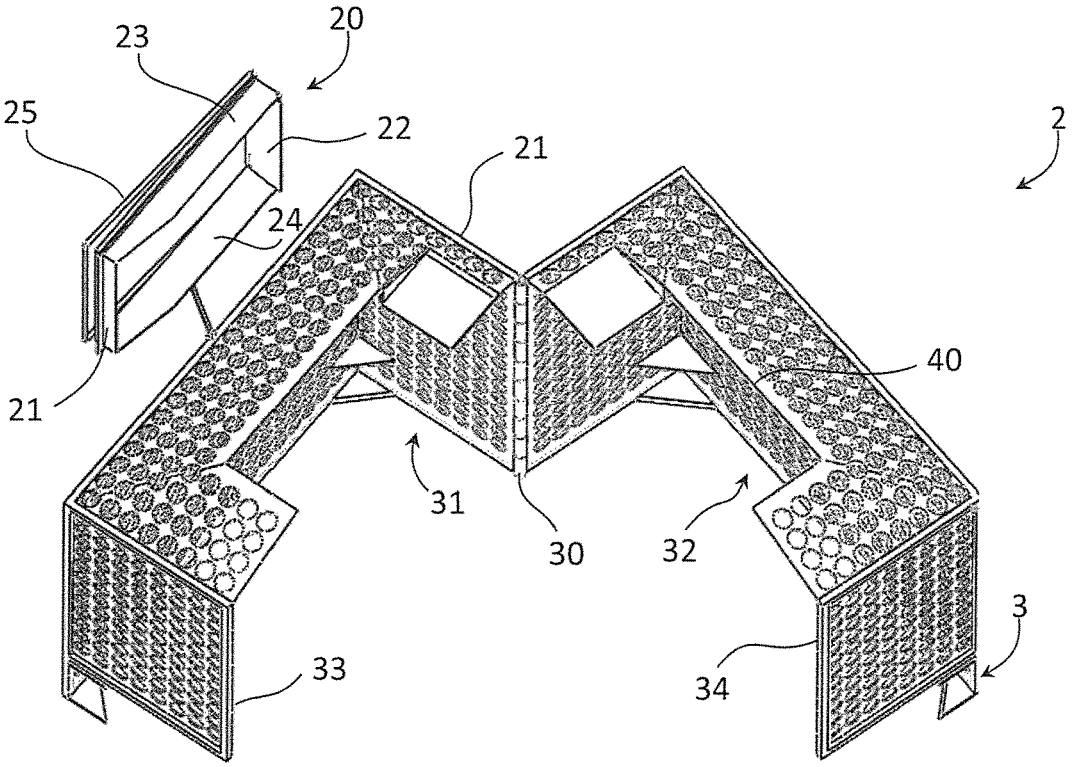
FIG. 2 is a perspective view from above of a cage of the compactor when open.
Figure 3:
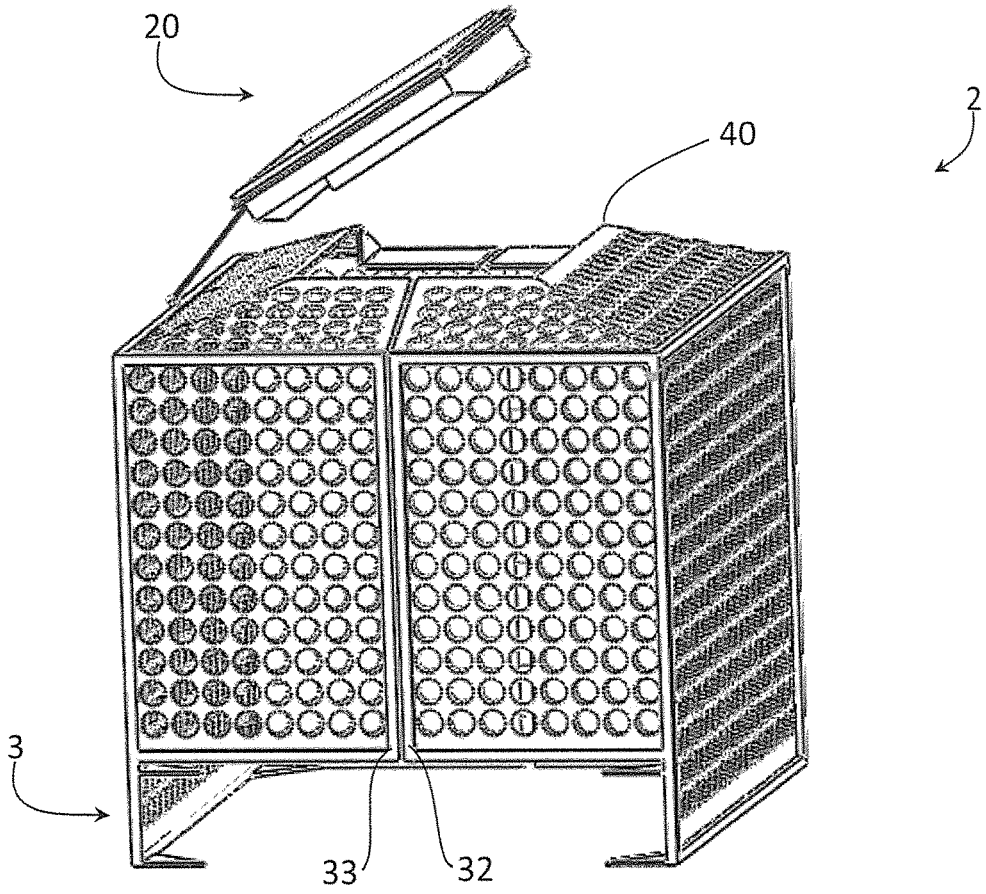
FIG. 3 is a front view of the cage when closed, with an intersecting piece being moved into position, the intersecting piece being in the form of a clamp rim around the top opening of the cage, the rim also in use taking the form of a rim around the lower edge of the compacting press housing.
Figure 4:
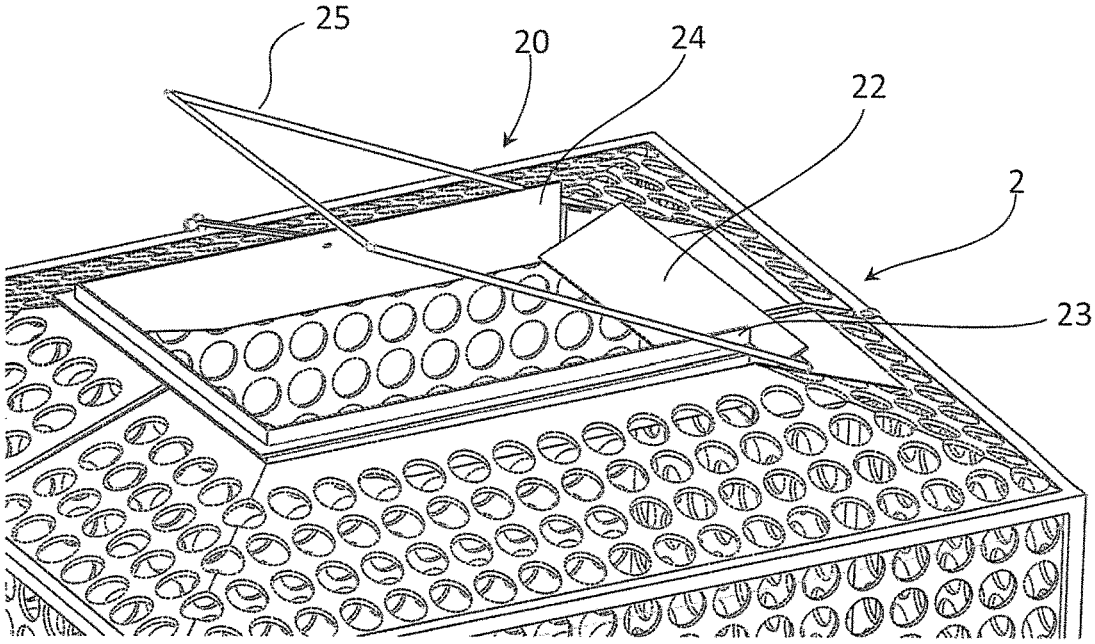
FIG. 4 is a perspective view showing the intersecting clamp rim in more detail.
Figure 5:
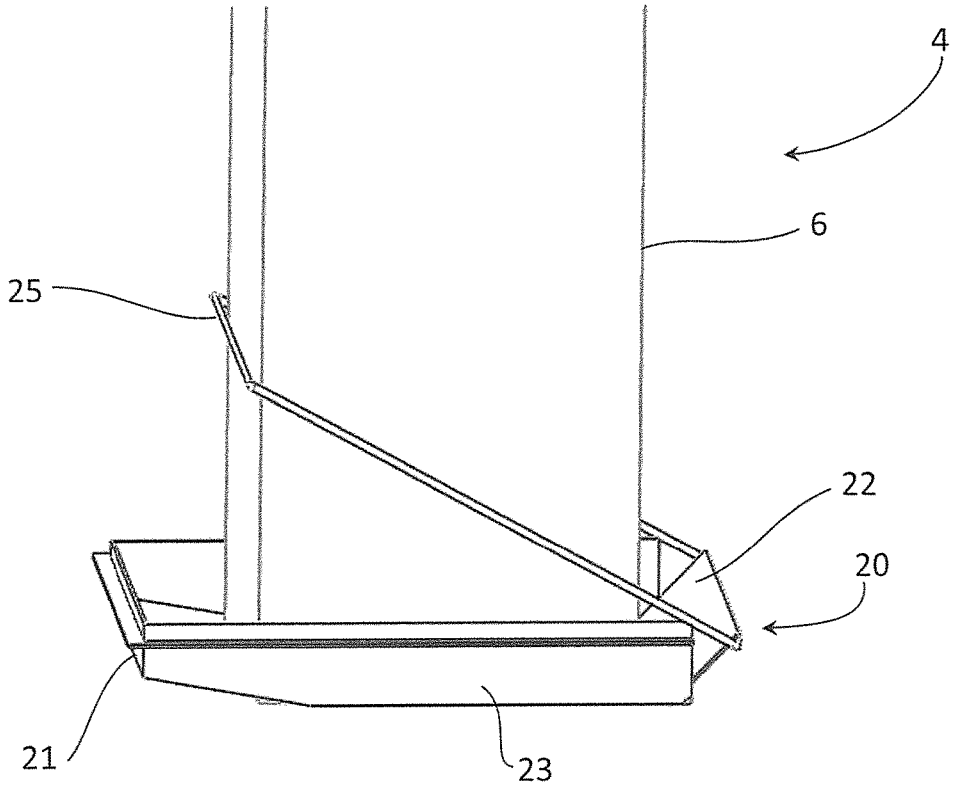
FIG. 5 is a perspective view showing the clamp rim in place around the bottom of the plunger housing.

Referring to FIG. 1 a waste compactor 1 comprises a cage 2 with a lower pallet space 3. A piston housing 6 is mounted vertically over the cage 2, engaging the cage 2 at an intersecting piece in the form of a clamp rim 20. The piston housing 6 comprises an actuator 7 driving a plunger 8 for vertical movement to press waste into a bag. The housing 6 has a door 9 for user insertion of domestic waste, such as from an apartment in an apartment complex.

Referring to FIGS. 2 to 6 the clamp rim 20 comprises a front wall 21, a tiltable rear wall 22, and side walls 23 and 24. There is a bar handle 25 hinged from back wall 22 to control tilting of the rear wall 22.

The cage 2 has a rear vertical hinge 30 linking two halves 31 and 32. The halves close over about the hinge 30 so that front edges 33 and 34 meet, and an opening is formed in the top of the cage 2 to receive the clamp rim 20. The halves 31 and 32 are each made up of panels which have a degree of flexibility especially due to their mesh construction. Hence the cage 2 contains the bag during compaction, but does so with a degree of flexibility whereby the mesh panels deflect during application and release of pressure.

When the clamp rim 20 is in place the handle 25 may be used to tilt the back wall 22, thereby allowing the cage 2 to be pulled (forwardly) away from the piston housing 6. This is shown most clearly in FIGS. 4, 5, and 6. When this is happening there will be a filled bag descending from the housing 6 and resting on a pallet. The neck of the bag will be wrapped from the inside-out around the rim. The pallet will be inserted in the space 3 at the bottom of the cage 2.

Figure 7:
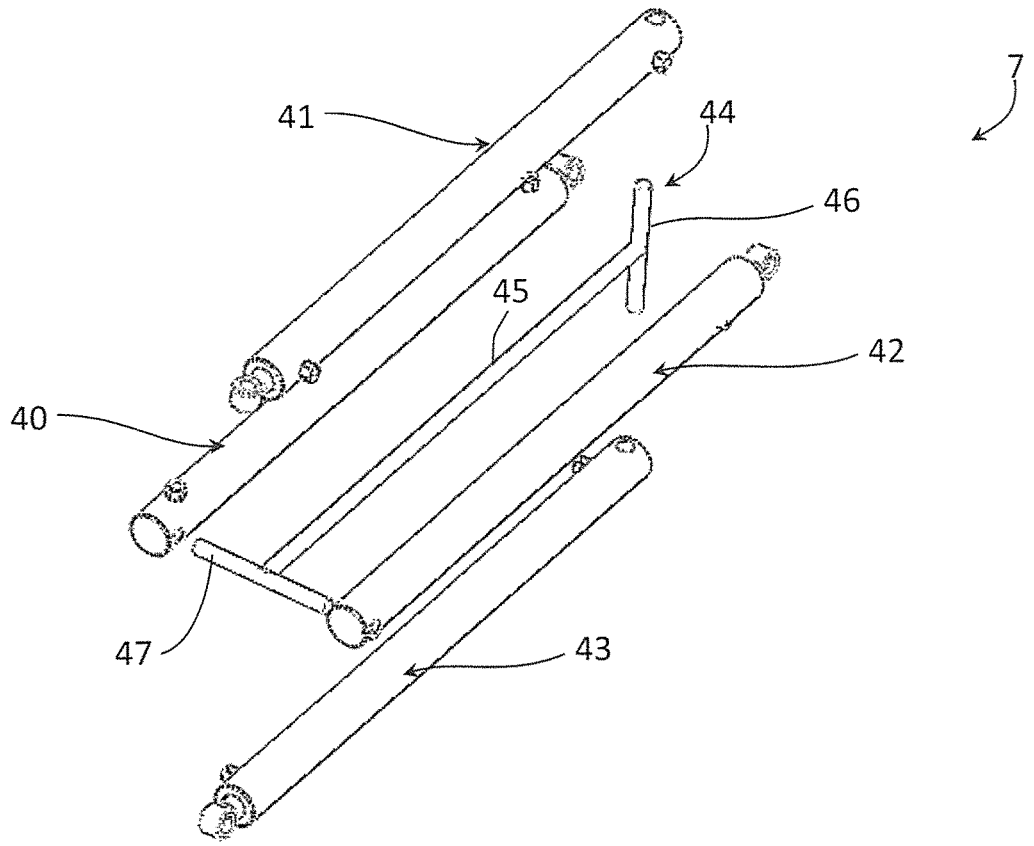
FIG. 7 is an exploded perspective view of a plunger actuator.
Figure 8:
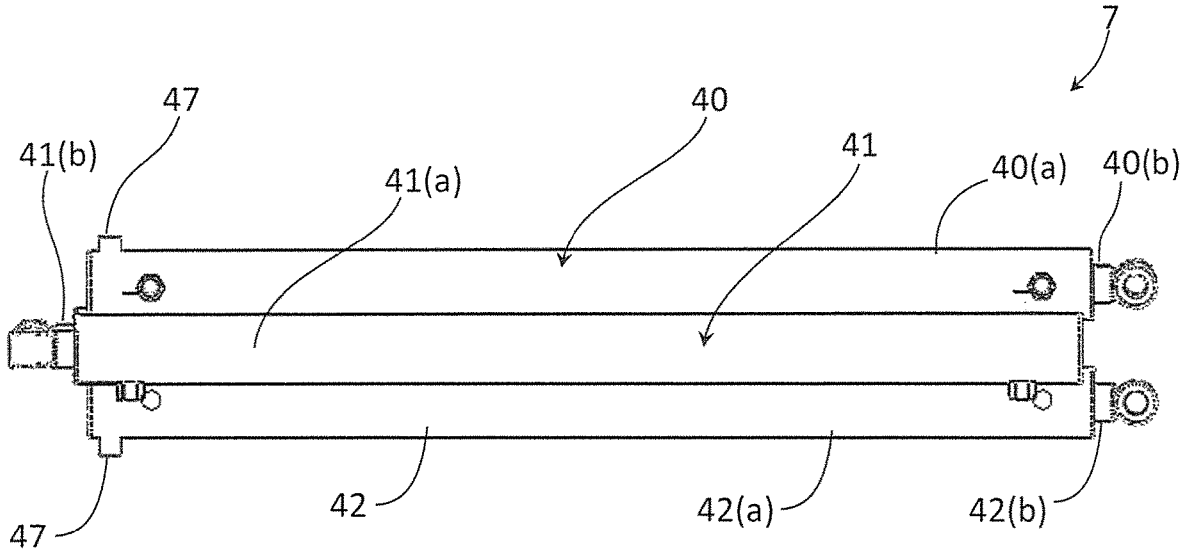
FIG. 8 is a front view of the plunger actuator.
Figure 9:
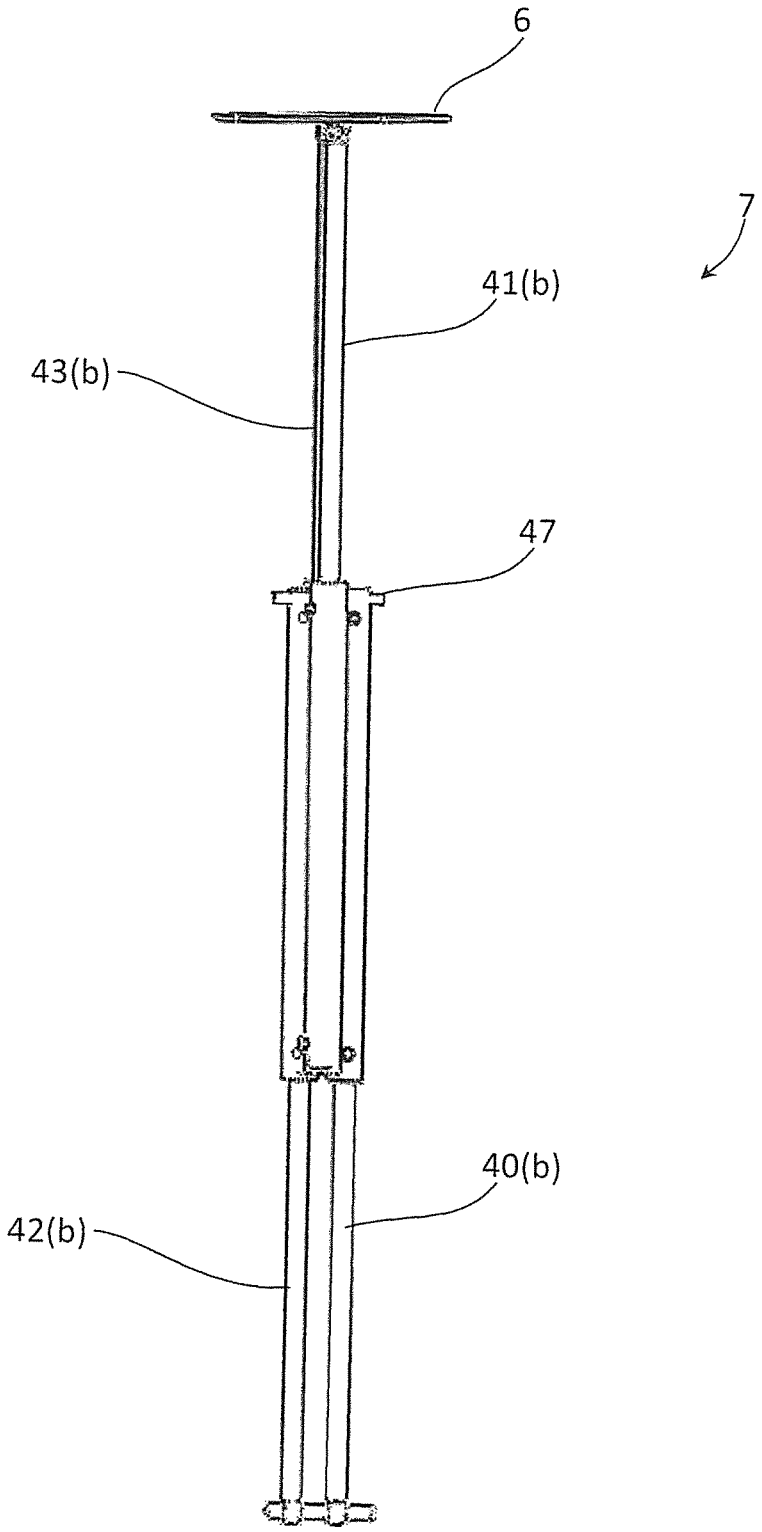
FIG. 9 shows the actuator in use.

FIGS. 7, 8 and 9 show the vertically-mounted actuator 7 in more detail. It comprises: two downwardly-faced cylinders 41 and 43, and two upwardly-faced cylinders 40 and 42.

Of course, where the plunger is driven horizontally these directions may be front and back rather than up and down.

The cylinders are mounted on a frame 44 ("I-frame") having a stem 45 with an upper T-piece 46 and a lower T-piece 47. The ram 40 has a cylinder 40(*a*) and a piston 40(*b*). Likewise, the rams 41, 42, and 43 have cylinders and pistons 41(*a*), 41(*b*), 42(*a*), 42(*b*), 43(*a*), and 43(*b*).

FIG. 9 shows operation of the actuator 7. The starting length of the actuator 7 is approximately the length of a single one of the cylinders. However, when the pistons extend the overall length of the actuator is three times this length because the pistons 41(*b*) and 43(*b*) extend upwardly, pressing against the housing 6 and so pushing the overall actuator, and hence the plunger 8, downwardly. Also, the pistons 40(*b*) and 42(*b*) extend downwardly as shown, to provide the overall tripling of the length, providing a stroke for the plunger of double the length of an individual piston. If one were to provide a single, larger, ram to achieve the same stroke it would need to have double the overhead height. Moreover, in addition to this space-saving aspect, the individual rams of the invention are simpler to maintain, are much less expensive, and require less hydraulic pressure in the hydraulic drive circuit. Also, the arrangement is more robust as the actuator does not completely fail if one, or even two, rams fail.

Operation of Vertical Compactor

In use, the cage 2 houses and contains the waste bag and pallet. The cage 2 provides containment for the force applied during the compaction operation and subsequent containment of compacted material. The bag acts as a liner and is not subject to excessive force. The material removed from the cage 2 will approximately mimic the geometry of the cage 2 and as such a desired shaped for the waste is achievable.

The hinge is parallel to the opening, but could alternatively be placed in location approximately tangential to the opening.

The handle lock 25 acts to secure the tiltable rear wall ("interference wall") 22 in position, and its secondary function is to raise the wall 22 for removal of the cage 2.

The handle 25 returns to the home (upper position, FIG. 5) position automatically when the cage 2 is inserted, securing the interference wall. The handle lock 25 lowers the interference wall at the same speed the cage is removed or up to a speed that the cage is removed. It is only when the cage 2 has been removed to a point where the height of the wall is equal to the distance the cage is removed and also the angle of the approximately tangential handle is sufficient to allow the interference wall will be fully horizontal or below the horizontal axis. This feature prevents material from exiting the containment area as the border wall geometry is maintained until the cage is ready to be being moved.

Figure 6:
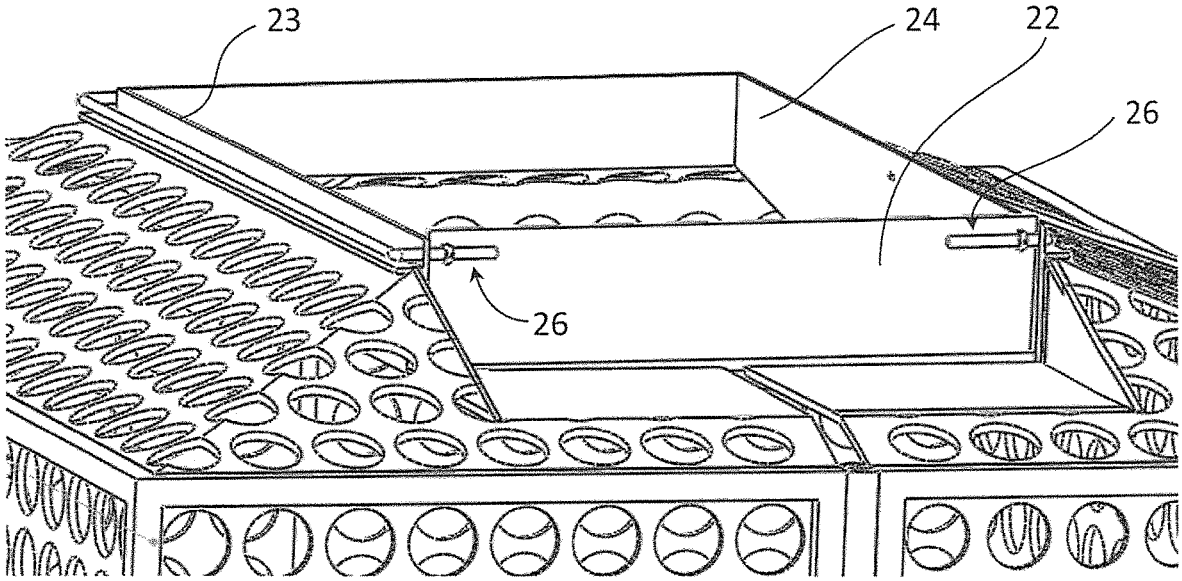
FIG. 6 shows a folding rear wall of the rim in more detail together with a hinge for a handle.

Regarding interference wall and handle operation, the handle lock 25 in home position is shown in FIG. 6. The geometry of the handle lock is not limited to the shape or geometry shown in the drawings. The interference wall 22 in the home position completes the geometry. This results in a border being created which surrounds and secures the structure inside the clamp rim 20, as shown in FIG. 6.

When the interference wall 22 is in the horizontal position it creates an opening, and the rear profile of the cage 2 allows the interference wall operation.

The pallet anchor 3 restricts the movement of the pallet. This allows also the cage 2 and the pallet to perform as a unit during operational function. A second function is that the pallet anchor allows the cage 2 and pallet to remain a unit during mobility. The pallet anchor can accommodate any of a variety of pallet sizes.

The clamp rim 20 is a multi-functional device. It houses the pivoting wall and handle lock assembly 22/25. Also, it completes the border geometry around the mouth of the cage. Further, the neck of a bag may be secured between the clamp rim 20 and the perimeter of the cage 2 opening. This prevents the bag being damaged, keeps the bag entry open and prevents the bag neck being pulled into the centre of the main body during the compaction cycle.

The clamp rim 20 is shown in the home position in FIG. 6, at which it performs the function of a lock to prevent the cage 2 from opening. The geometry of the cage 2 and of the clamp rim 20 result in an interference boundary wall between the two vertices resulting in the inability to open the cage 2 until the clamp rim 20 is clear of the home position.

With a bag in place with its neck folded around the clamp rim 20, and the cage in place, the plunger 8 can press waste down into the bag. The cage 2 withstands the compaction forces, and not the bag. Hence, a light bag of low strength can be used. It is envisaged that the bag may therefore be compostable. When full, the rear rim wall 22 is tilted using the handle 25, the cage 2 is pulled forwardly, the cage 2 is opened, and a pallet truck removes the pallet with the full bag on it.

The cage 2 as described above is made up of a number of panels. The panels, due primarily to their mesh configuration but also the hinge 30 at the link at the edges 33 and 34 can flex outwardly under pressure from the press and relax upon retraction of the ram. This allows not only containment of the compacted waste in a bag but also dynamic volume change and application of force on the waste by the panels as they deflect back in. This assists uniform distribution of the waste and optimum use of the space in the bag. This effect is more pronounced in other embodiments described below (horizontal compactor) in which panels are cantilevered individually to deflect about a single side edge, and the benefits of deflection and control scheme aspects are described in more detail for these embodiments, but apply for this embodiment also.

It will be appreciated that the system allows for reliable compaction of waste into a bag without need for the bag to be of high strength material. This allows less expense, and compact storage of the bags before use because they are of a light material. Also, the bags when full are in a desired shape, comfortably fitting on a pallet and so may be easily removed and transported. A further advantage is that the compactor does not need to be excessively high, due to the arrangement of the compacting press actuator.

Alternative Actuators

For any embodiment, the actuator may have rams facing in opposite directions in an arrangement different from that of the actuator 7. The frame 44 of the actuator 7 has T-pieces each supporting two rams. However there may be a different number and arrangement of rams.

Figure 10:
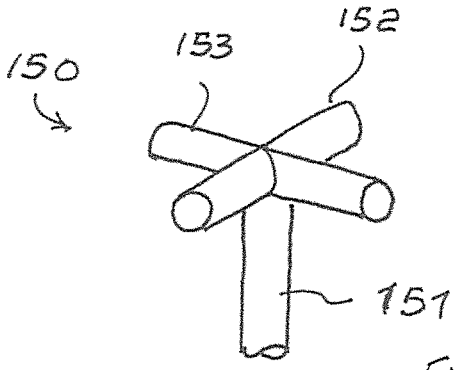

FIG. 10 shows a frame 150 with two T-pieces 152 and 153 at each end, for supporting a total of eight rams.

Figure 11:
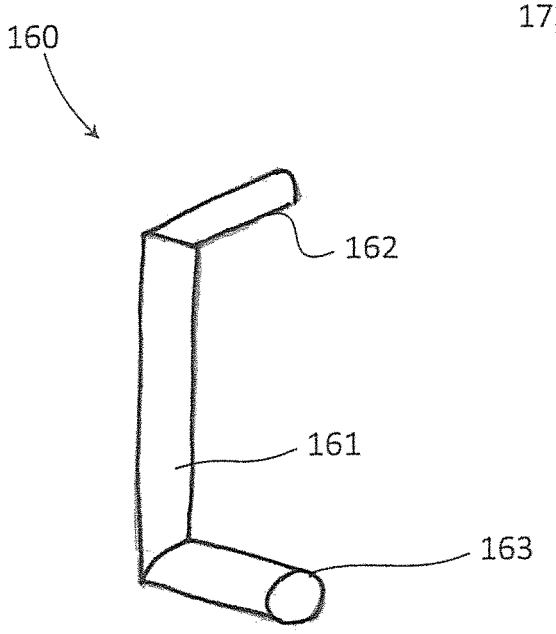
FIGS. 10 to 13 are views of frames of alternative actuators.

FIG. 11 shows a frame 160 with a stem 161 having a single cranked extension on one side only at each end, namely extensions 162 and 163. This can support two rams in total.

Figure 12:
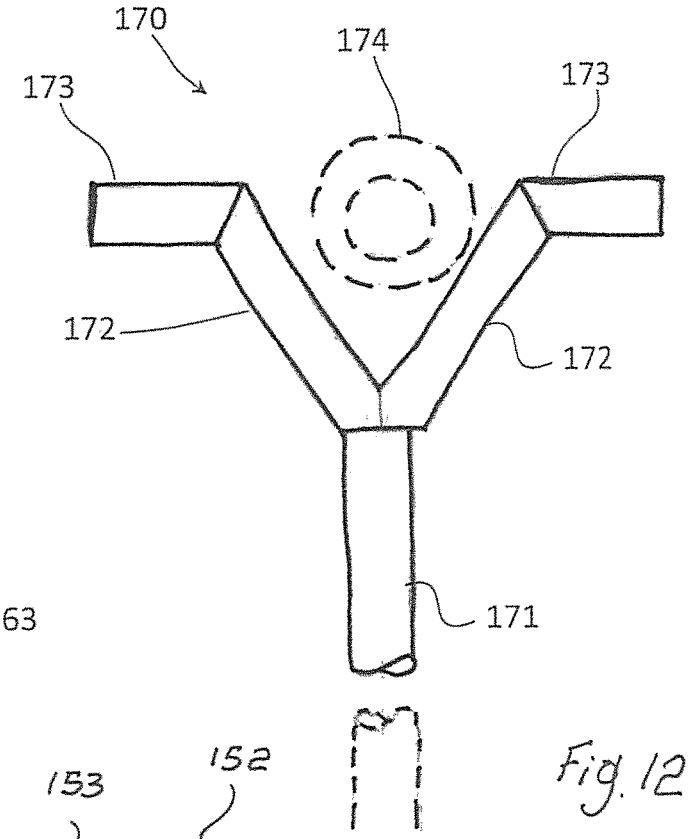

FIG. 12 shows a frame 170 having Y-shaped ends, with a stem 171, and splayed-out arms 172 having radially-extending ends 173. This arrangement can support a multiple number of rams, but there is a space between the splayed arms 172 to accommodate a connecting bar (eye) 174 for the rams supported at the other end of the stem 171.

Figure 13:
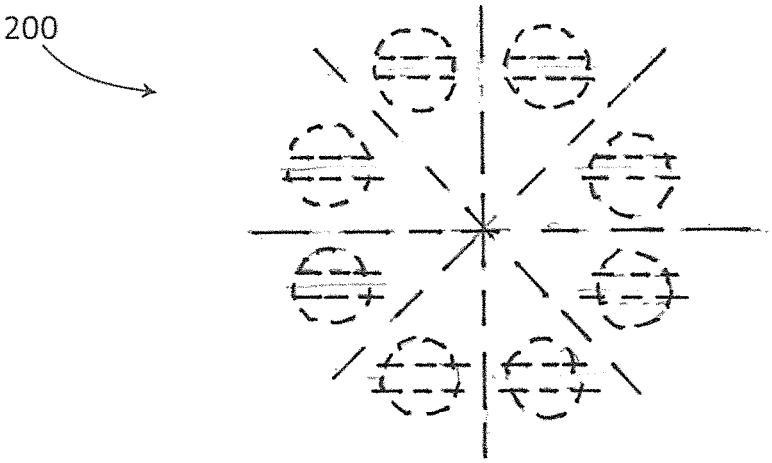

FIG. 13 shows an assembly 200 having multiple rams using the I-Frame to house the ram anchors in a concentric fashion in the same plane.

Horizontal Compactor

Figure 14:
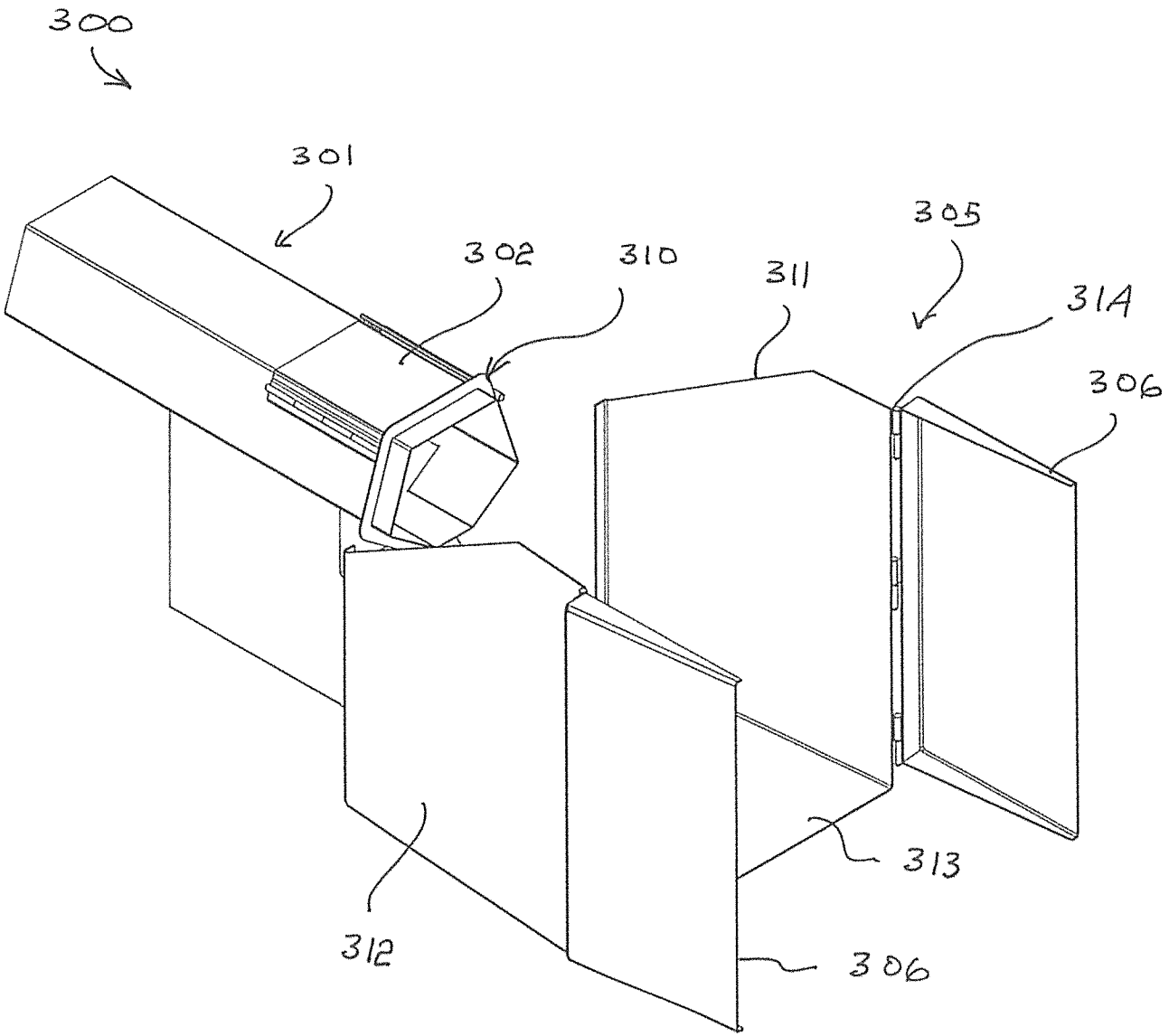
FIGS. 14 and 15 are side and front perspective views of compactor of another embodiment, in this case with a horizontal pressing axis.
Figure 15:
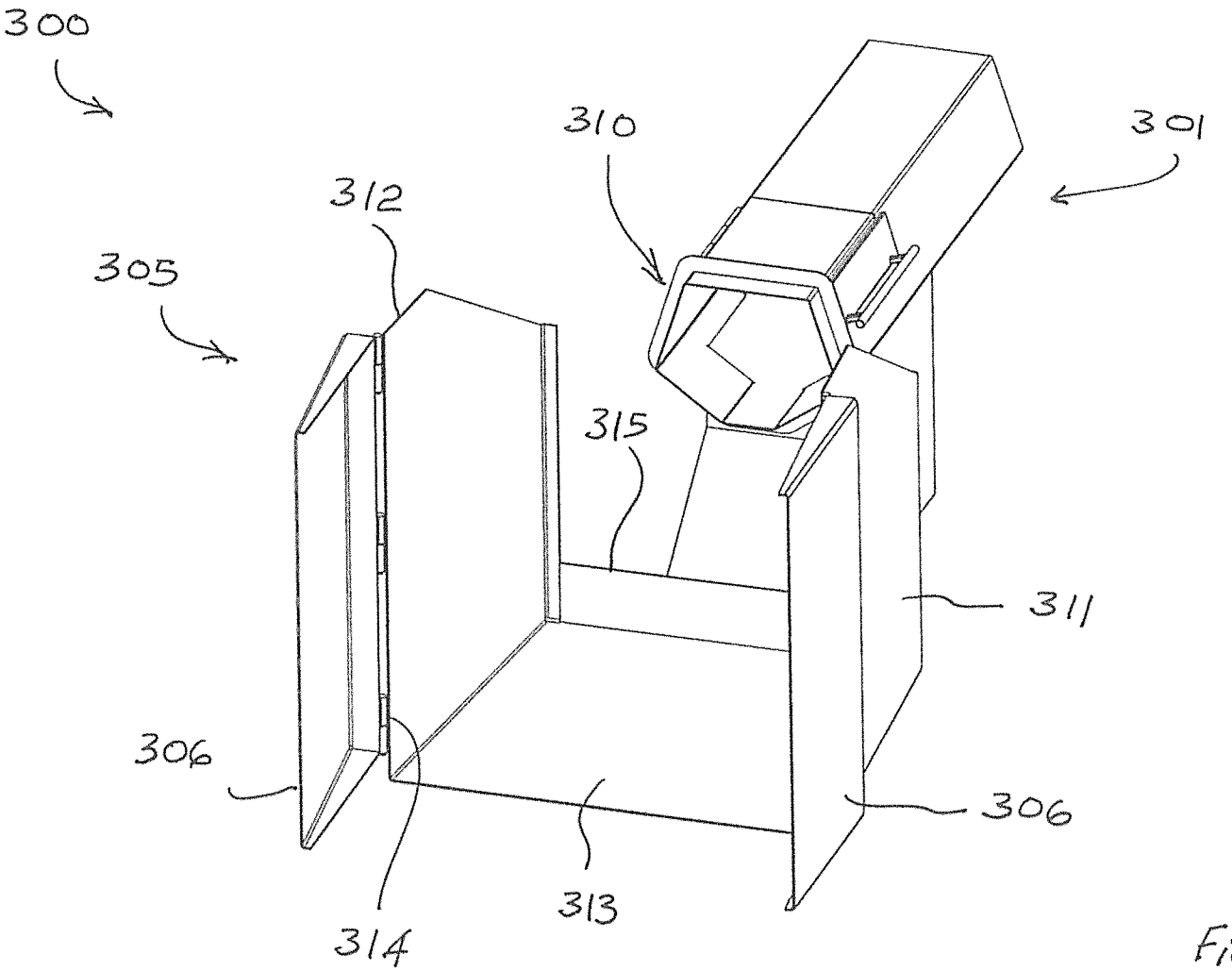

It is not essential that the plunger stroke be vertical. A horizontal compactor 300 is shown in FIGS. 14 and 15. In this case a plunger housing 301 is horizontal, with a door 302 for insertion of waste. The plunger presses waste into a bag the neck of which is tied to a front rim 310 of the housing 301. The bag is on a pallet P within an enclosure 305 with panels rather than a mesh. The enclosure 305 has a pair of doors 306 at the rear, which open to allow access by a truck to remove the pallet P with the bag in place on it.

The enclosure 305 also comprises a pair of side panels 311 and 312, both of which are fixed on one side edge by being joined along their lower edge to a floor panel 313. The side panels 311 and 312 support the end panels 306 at vertical hinges 314. The end panels 306 are connected along their outer vertical edges in a "saloon door" arrangement by a lock which allows a degree of freedom of movement.

Hence, in the enclosure 305 there is resilience due to the ability of the various panels to move, in which:

- each side panel 311 and 312 is cantilevered about the corner at which it is joined to the floor panel 313, these axes being parallel to the press longitudinal direction; and
- the end panels 306 can rotate about the relevant vertical axis of the hinges 314, these hinges being normal to the longitudinal direction.

The actuator of the compactor 300 may be the actuator 7 or any of the other actuators described above, or indeed a conventional ram arrangement. In this case there is often less of a requirement to minimize the length of the compactor in the longitudinal direction because overhead space is not required, however, it will still often be preferable to minimize this dimension.

In this embodiment there are two panels (311 and 312) which are fixed on only one edge (with the lower panel 313), and so have three free edges i.e. edges which are free to move so that the panel can deflect about the fixed edge. While the panels 311 and 312 have an edge which supports a door 306 at a hinge they are still free to deflect. It is envisaged that in other embodiments some panels may have two sides which are fixed, thereby giving less freedom to deflect.

Operation of Horizontal Compactor

Figure 16:
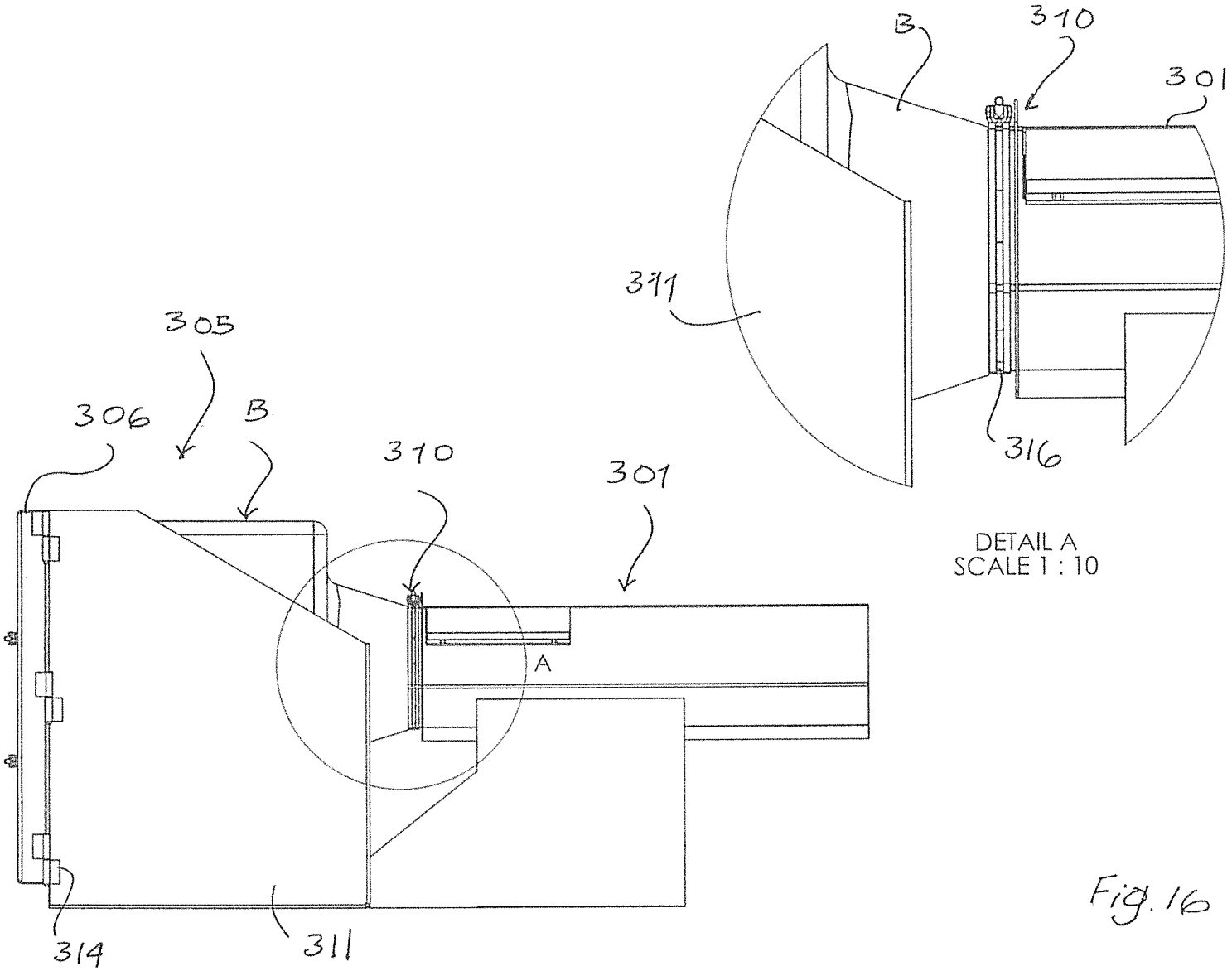
FIGS. 16 and 17 are side and perspective views showing the compactor in use with a bag in place being filled.
Figure 17:
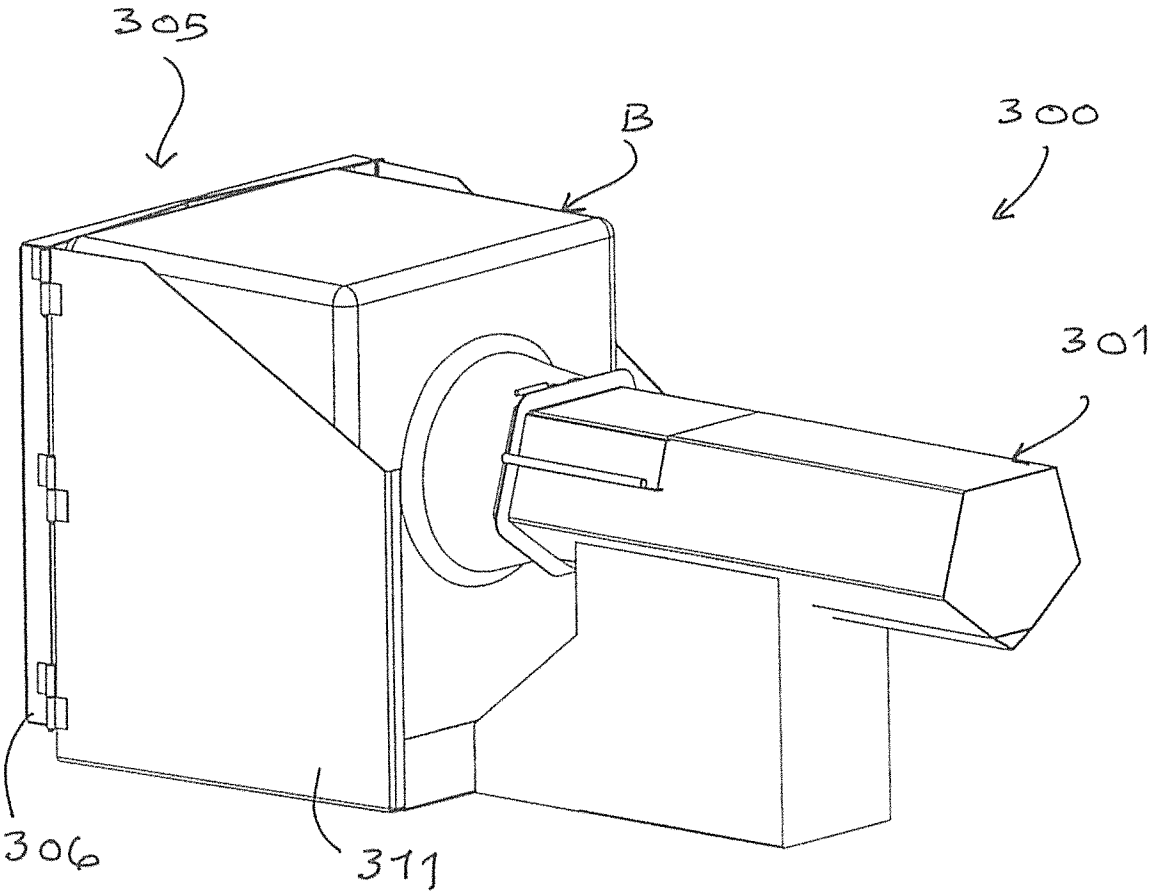

Referring to FIGS. 16 and 17, in use, a bag B is mounted to the compactor by its mouth being inserted between the rim 310 and a clamp 316 of the Jubilee clip type. However, any other type of clamp which retains the mouth of the bag in place would suffice, provided it applies the required extent of force to retain the bag in place against the longitudinal forces which arise in use. These diagrams show the bag B after it has been filled, and has a generally cuboid shape due to the manner in which it is efficiently filled as described below.

Figure 18:
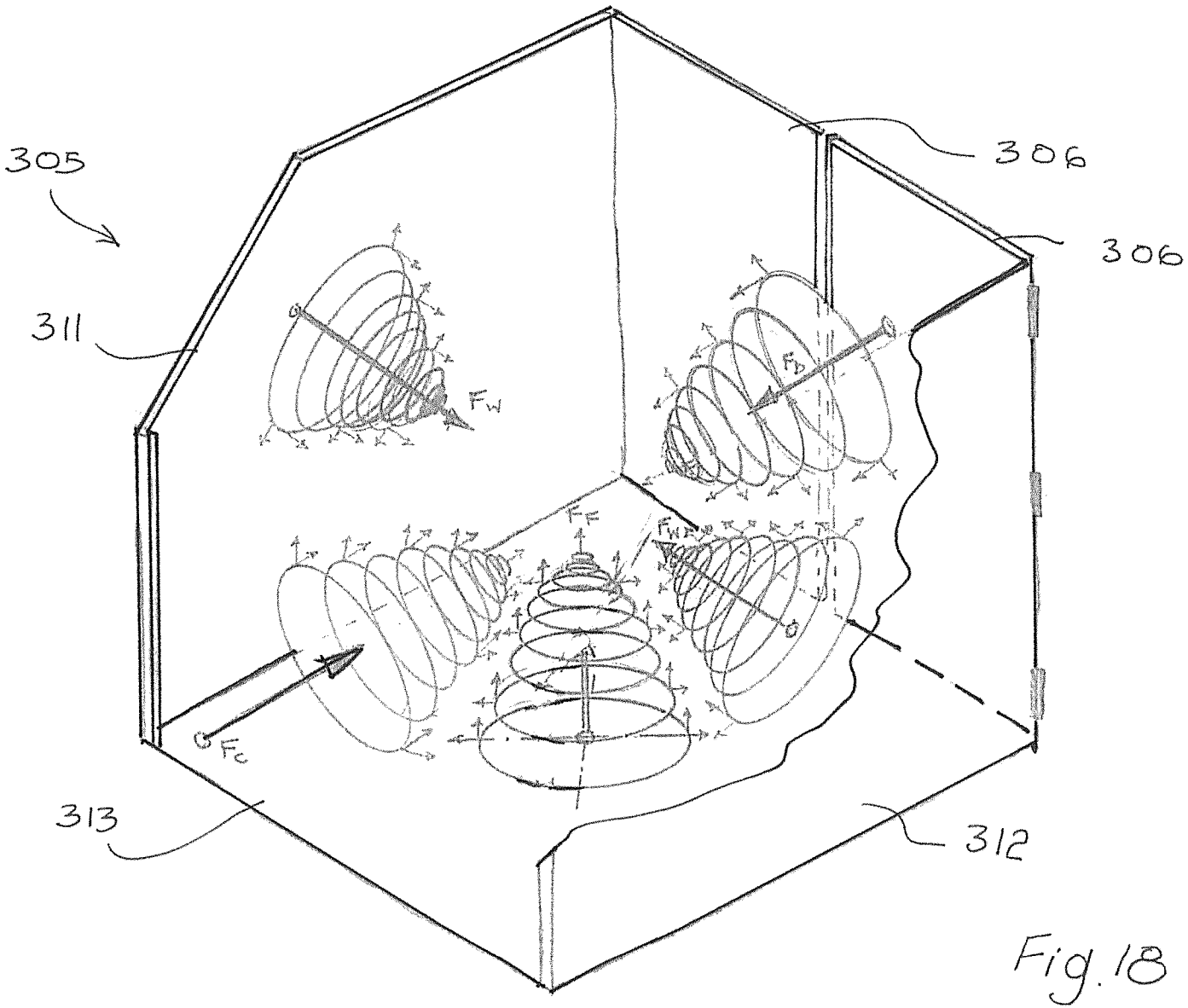
FIG. 18 is a perspective view showing forces which arise within an enclosure of the compactor of FIGS. 14 to 17; in use.

FIG. 18 illustrates the three-dimensional ("3D") forces acting on the waste material within the enclosure 305 and the bag B, in which $F_C$ is a compaction force applied by the press, $F_D$ is a reaction force from the doors 306, $F_W$ is a reaction force from the side walls 311 and 312, and $F_F$ is a reaction force from the floor 313. It should be noted that these forces acting on the waste create a pressure wave, depicted here as a cone.

As the enclosure 305 begins to fill, the walls, doors, floor and bag faces push back against the waste in response to strokes of the press, and pressure wave cones will interact. Some of the force vectors will cancel each other out, with resultant forces directing the waste into the regions or voids (zones) of low pressure. When the enclosure 305 and the bag B begin to fill this cancelling (equalization) out of forces will start a process of settlement.

The walls and doors are subjected to movement when the waste bears upon them due to the compaction force. When the compaction force $F_C$ is relieved i.e. when the press is on the return stroke, the walls and doors will also be relieved and try to move back to their start position. This movement of the enclosure 305 planes can be considered dynamic. Thus the compaction force, mechanical resistance of the enclosure 305 planes, elastic resistance of the bag can be termed 'dynamic compaction settlement'.

As the doors hinge backwards from the compaction forces, the distally-facing pressure cone splits into two, one from each door, with both cones set at one angle and the cones directed inwards, assisting equalization of forces, and settlement. The press of the compactor 300 advantageously does not encounter shear forces. This is because it is an exact fit within the plunger housing 301 and the door 302 is opened to allow the user to place material/waste into the chamber of charge box. The door is then closed and effectively remakes the shape of the outer tube. The inner tube or plunger can then traverse along the outer tube pushing its contents before it, into the enclosure 305.

Figure 19:
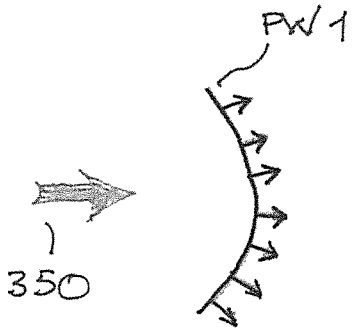
FIGS. 19 to 34 are diagrams illustrating how forces are applied and how waste spreads efficiently and comprehensively into the space available within a cuboid bag during operation of the compactor of FIGS. 14 to 17.
Figure 20:
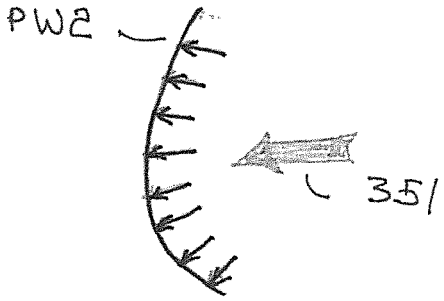
Figure 21:
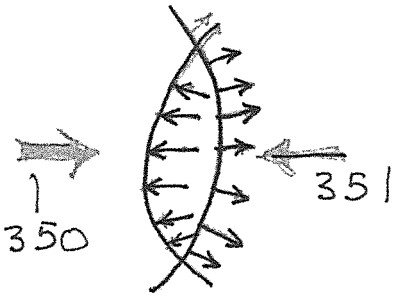
Figure 22:
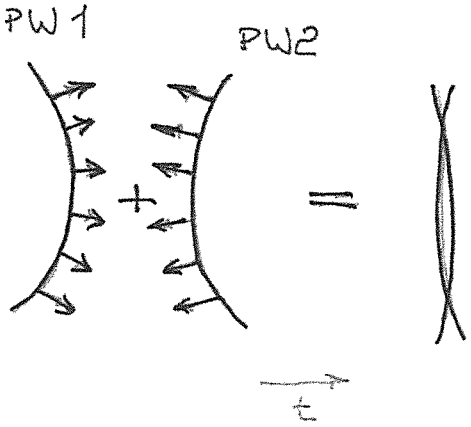
Figure 23:
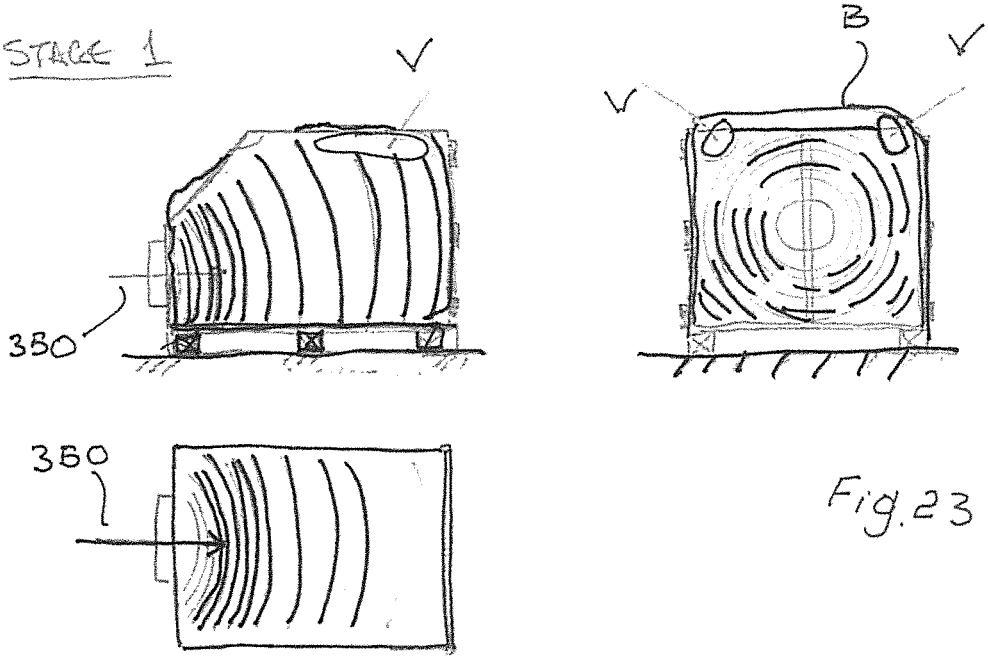
Figure 24:
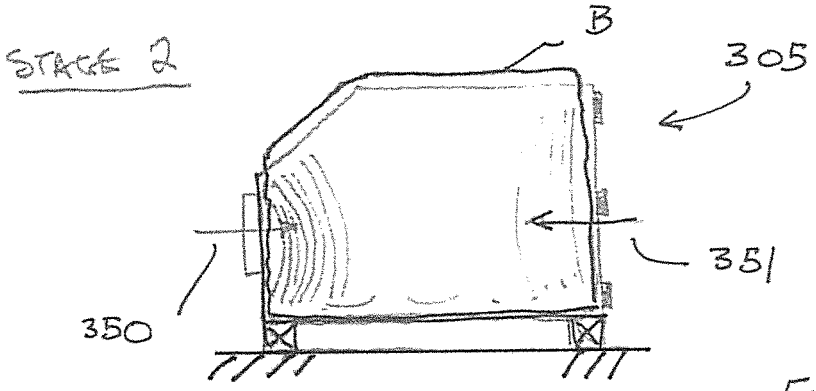
Figure 25:
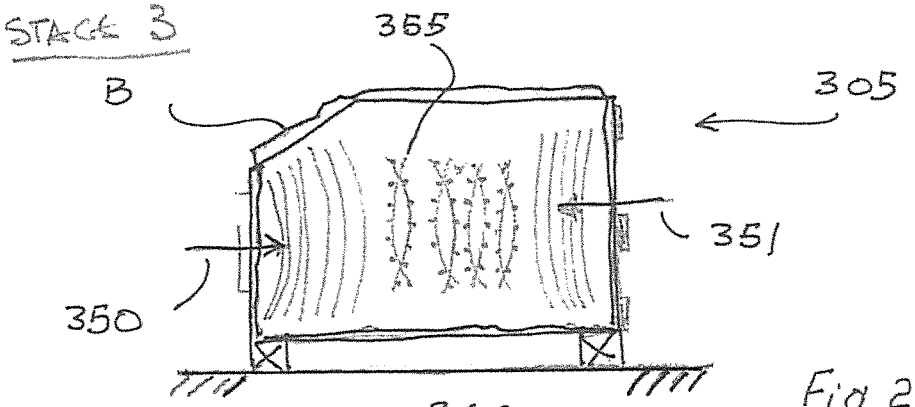
Figure 26:
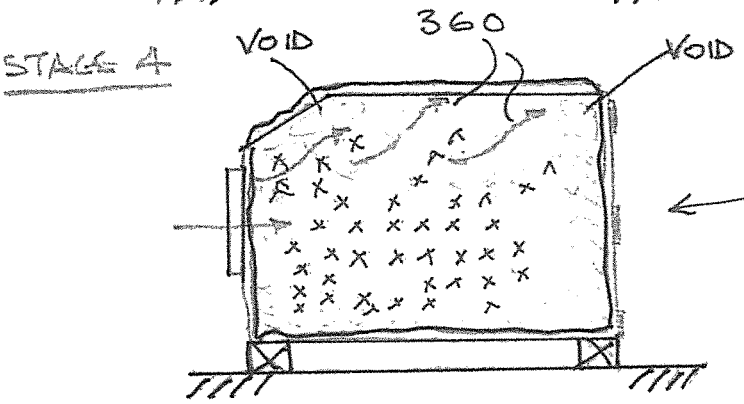
Figure 27:
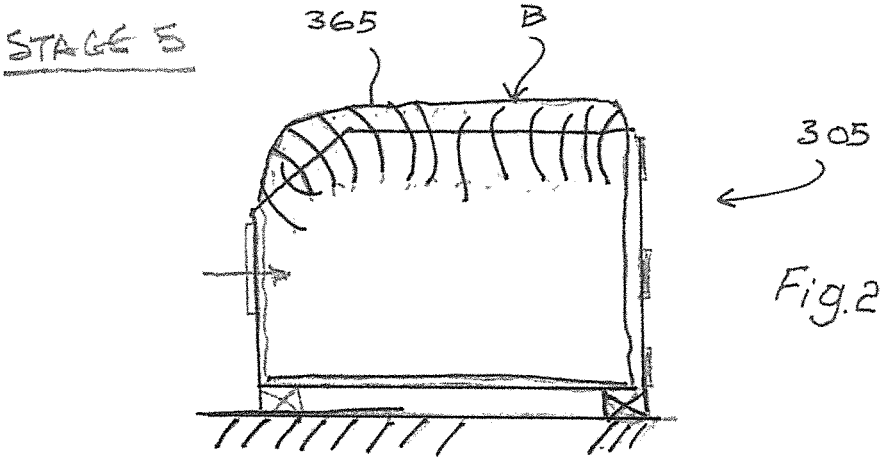
Figure 28:
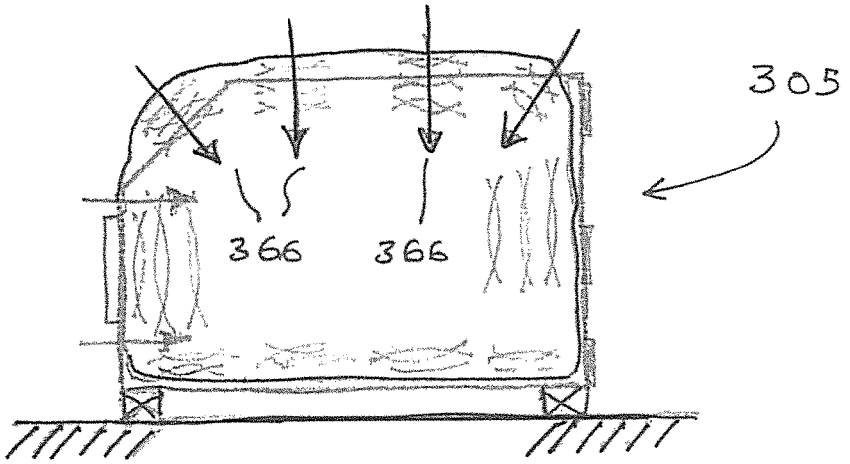
Figure 29:
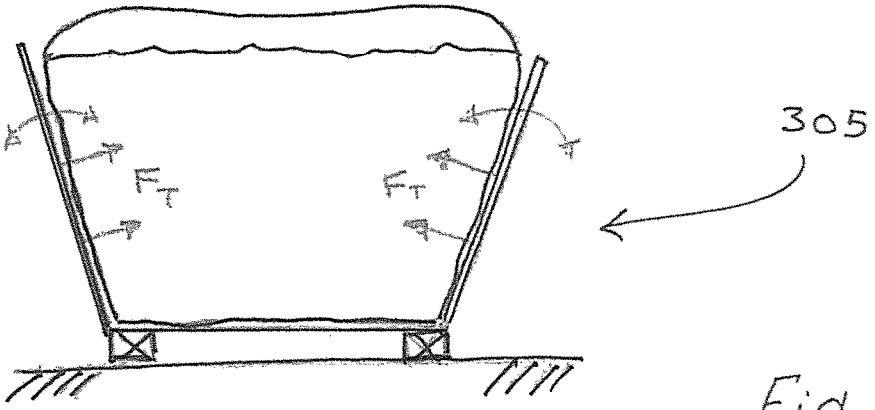
Figure 30:
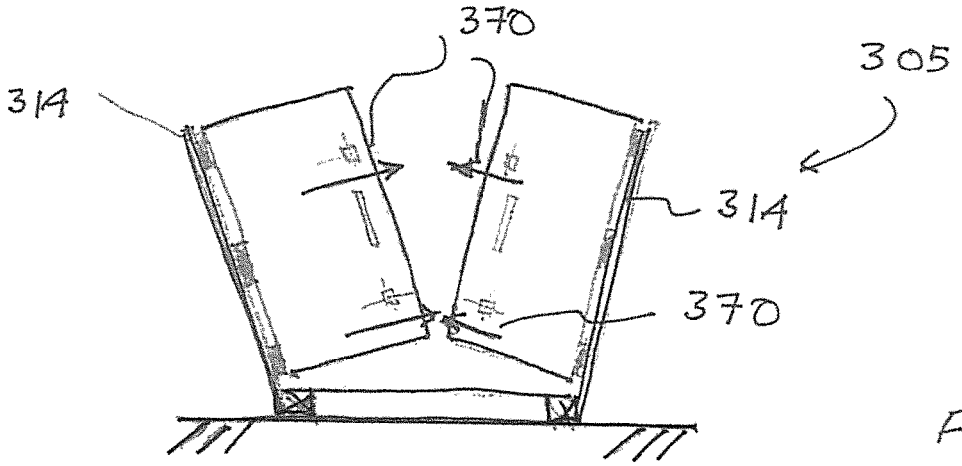

Referring to FIGS. 19 to 34 the following aspects of use are shown:

| FIG. | Description |
|---|---|
| 19 | With distal movement of the plunger causing compaction force 350 there is a pressure wave PW1 moving distally into the bag B |
| 20 | There is a pressure wave PW2 arising from a reaction force 351 of the doors 306 resisting the distal pressure |
| 21 and 22 | The above two pressure waves meet and there is settlement as the sum of these two forces approach zero |
| 23 | The relative extent of the pressure within the waste is shown, being at an early stage greater towards the proximal (open) end of the enclosure 305. |
| 24 | The compaction 350 and reaction forces 351 shown in side view for the bag B as a whole, corresponding to FIGS. 19 and 20 |
| 25 | Meeting of pressure waves 355 at a central region of the bag B in the axial direction (corresponding to FIG. 21), causing the waste to become denser in this central region. |
| 26 | This increased density causing an upward shift 360 of waste into upper voids and less dense regions |
| 27 | Filling and expansion of the bag B at its top fabric wall 365 |
| 28 | Resultant reaction forces 366 of the top wall 365 of the bag, arising from the movement shown in FIG. 27. In this case it is solely the flexible top wall 365 of the bag B which reacts to provide a reaction force, as the enclosure 305 is open at the top. |
| 29 | A combination of the axial plunger and reaction forces and the upward migration and bag panel reaction forces result in lateral forces Ft against the side panels of the bag B and hence against the side panels 311 and 312. These give rise to the panels 311 and 312 pressing back due to the spring force arising from their cantilevered connection to the floor panel 313. The side panels 311 and 312 are effectively acting as cantilevers or leaf springs at this stage. |
| 30 | The forces shown in FIG. 29 cause the door 306 hinges 314 to tilt laterally, and a restraining force 370 is also applied by the door clamps. |
| 31 | The forces of FIGS. 29 and 30 shown in plan. |
| 32 | Overall cancellation of forces as the bag B becomes full. Settlement of the waste, resulting in zero internal forces after time t. |
| 33 | Diagrammatic view of an enclosure 400 arranged to receive a vertical press applying vertical force 405, and having panels |

-continued

Figure 33:
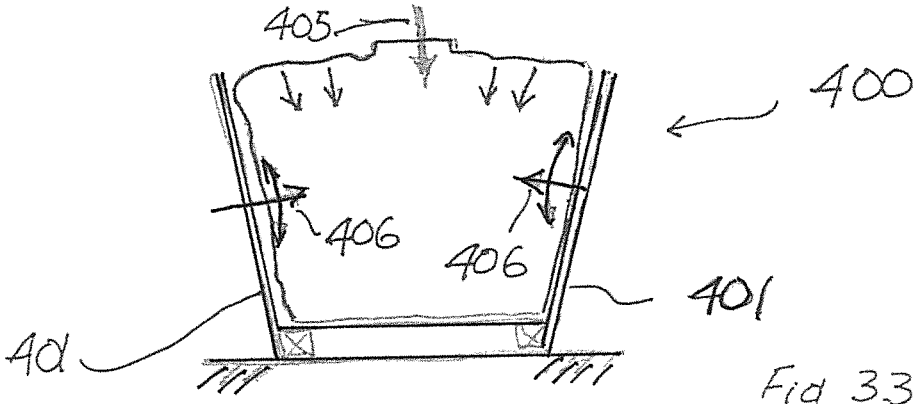
Figure 34:
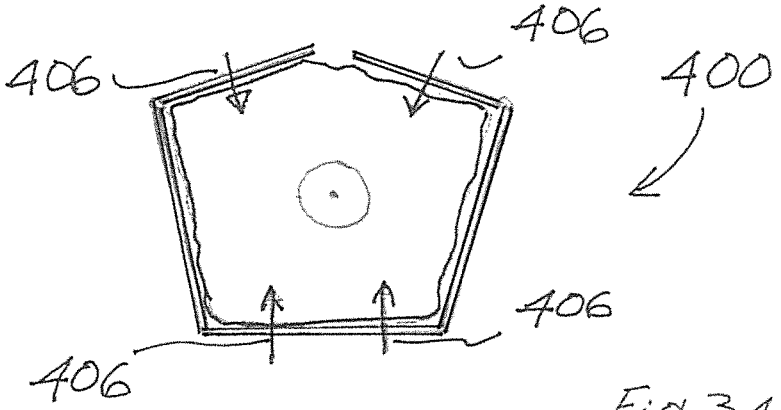

| FIG. | Description |
|---|---|
| | 401 which deflect about horizontal side edges to apply reaction forces 406 inwardly. |
| 34 | Plan view of situation in FIG. 33 |

It will be appreciated that the containment enclosure is a flexible structure that provides support and aids compaction, being analogous to the human respiratory function. In the latter the flexible rib cage provides support when subject to forces and when the lungs are full the compressive forces needed to exhale are provided by the lung muscles and diaphragm structure and as well as the natural elasticity of the muscle, tissue and bone structure. The enclosure 305 steel surfaces can be thought of as analogous to the skeletal, rib and muscle structure and the open top of the enclosure 305 can be thought of as the region occupied by the human diaphragm. The enclosure provides rigidity as well as flexibility and responds adaptively to pressure/force applied.

During the compaction process, waste material added travels into low-pressure zones or voids. The method of having a flexible bag and a part open containment unit or enclosure allows the material to climb/build up in low pressure zones. The material acts against the bag and causes the bag to stretch. The mass of the material in the low-pressure zone accumulates and creates a force tangential to the mechanical compaction. This force acts on the material in the bag providing secondary compaction. This force is additive. The bag material will provide compressive forces in all planes, but is restricted in the regions that are walled thus providing direct proportion force in desirable directions to compress material on all faces, which will result in the bag bulging. This bulging is a result of material expanding into low pressure regions and the natural elasticity of the bag. The continuing compaction process results in the bag obtaining a definitive geometric shape, with internal volume fully exhausted, this results in pressure being applied on all faces of the bag uniformly as the natural elasticity of the bag has reached its elastic limit prior to plastic deformation. In addition, the CU aids a transition which allows the polymer chains to deform to reach bag material plastic limit, thus re-enforcing the containment and application of uniform pressure on all surfaces of the bag. This continuing compaction process results in the once low pressure regions now becoming high pressure zones and the resultant forces created, further compact the material.

The material entering the bag/containment structure under pressure is subject to initial axial compressive forces, however once the material experiences enclosure panel resistance the material will also experience tangential compressive force. The material being compressed will initially react tangential to the force and if there is a force either indirectly or directly applied it will expand into low pressure regions/voids within the bag. The material is allowed climb/re-orientate/settle/decompress/recover into vacuoles/voids. This allows the material enter into voids which are normally inaccessible. The material now has the ability to protrude beyond a plane of the enclosure.

As the material enters into a volume, it is met with material of a higher density or compacted value. Under normal circumstances the compaction of the new material is a ratio of resistance provided by existing material and pressure applied. The absence of a solid surface allows the newly entering material to deflect off higher density material and climb into the low-pressure zones. This process is repeatable until the low-pressure zone is exhausted.

The material is met with resistance on 3 sides, the deflection of the walls causes resultant forces and deflects the material upward after a critical point in the material density is reached. This may be referred to as a waste (material) "wall". In the initial stages the wall is formed due to resistance provided by the steel surface. As the surface is flexible beyond a certain pressure, the material is deflected at degrees proportional to the pressure applied. This variance in deflection is to aid distribution of material and further aid compaction. The deflected walls have themselves elastic properties and once the material is deflected into lower density/pressure zones, the walls return to a lower energy state. This also aids the compaction process. As returning walls further compact material. This process is cyclical with new material added until max density and volume is reached.

The existing compacted material also has the ability to climb, depending on density and low pressure available volume.

The bag allows rapid escape of air through the weave ensuring even distribution qualities of waste compaction. Also, the enclosure works in conjunction with the FIBC (flexible intermediate bulk container) bag material so the enclosure does not have to be made of excessively strong material. It provides:

- Form or stackability, removing memory waste and retaining shape using form and elastic limit of bag. Even distribution of form to create consistent geometry.
- Resistance The initial stages of CU fill; the material entering has no resistance and therefore not compacted. As further material is added, available volume is reduced and once the sufficient volume is reduced/occupied by material. The mechanical compaction process begins on new material introduced.

The function is to breathe, thus allowing the entering waste not only to be compacted but restrictive regions normally not accessed or require massive force to facilitate compaction are not required. Advantages include:

- Dynamic response to compressive forces.
- Containment unit is both a static and flexible container, and it is responsive and dynamically adaptive to pressure.
- Also it massages the waste into zero/low pressure zones and voids.

The CU forms a definitive geometric shaped FIBC/Bag.

It will be appreciated that many of these advantages also apply to the compactor 1 due to the enclosure cage 2 having resilience due to freedom of movement about the vertical hinge 30, parallel to the axial direction, and due to the fact that the enclosure 2 is formed of a mesh, thereby having resilience to deflect like multiple high-tensile diaphragms.

Figure 35:
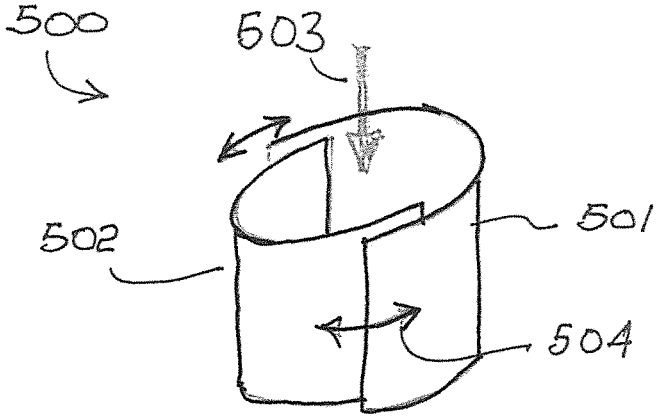
FIG. 35 is a diagrammatic perspective view of an alternative enclosure for a compactor of the invention.

An alternative enclosure 500 is shown in FIG. 35, with two curved walls 501 and 502 each forming a C-shape in plan with the open sides facing each other and engaged by couplers along the facing edges. There are vertical compaction forces 503 applied by a press, and reaction forces 504 applied by the walls 501 and 502 due to the fact that they are clamped together along their vertical side edges by a clamp having resilience.

Summary of Operation in One Example

The enclosure is empty.

Waste enters driven by axial force $F_C$ from the plunger (compacting press).

The waste touches the rear doors 306, and they offer typical solid surface static axial resistance force.

Figure 31:
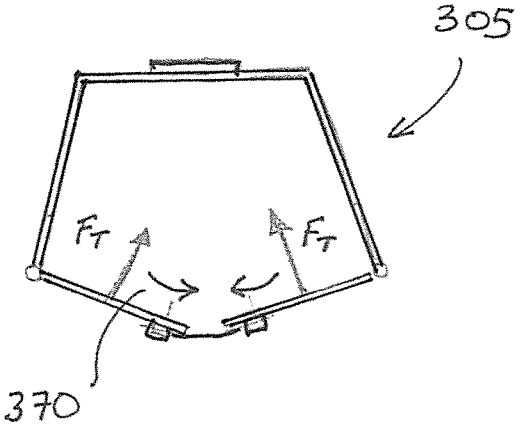
Figure 32:
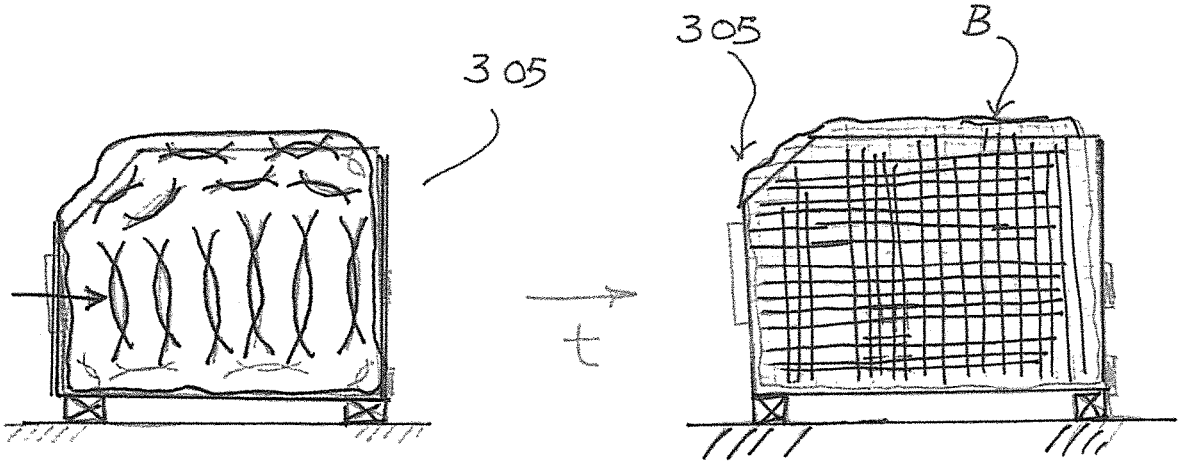

With further waste entering, the doors 306 increasingly deflect and create Ft reaction forces in a 2D plane which concentrates the waste in the triangle formed by $F_C$ and the two Ft forces, thus compacting the waste more in the central door area (FIG. 31).

Further waste then begins to move away from the central door area along the side walls which exert typical solid surface static tangential resistance force.

Waste then effectively climbs up the side walls 311 and 312 as the enclosure begins to fill in a 3D fashion.

The side walls begin to increasingly deflect and a variable distributed load is exerted up their height. This creates reactive side wall forces Ft along the panel curvature, which are pressure and height dependent.

As the side walls are deflected outwards and create a moment about their bottom edge, the Ft forces on the waste help to direct it upwards to fill the voids, helping to relieve the differential waste density.

In addition, as the side walls deflect outwards they exert a tensile force on the doors which effectively straightens them out, and they move inwards back to their original position, thus exerting further cyclic compressive reactive force on the waste.

When the plunger forward motion is reversed, the forward compressive compaction force is relieved, and the only compressive forces exerted on the waste are reactive forces from the doors and side walls.

As the plunger again moves forward the cycle of direct compressive compaction force, and reactive forces is repeated.

As the enclosure begins to fill, the bag B top and front surfaces start to bulge outwards, and exert an elastic reaction force on the waste.

When the bag is quite full, the elastic force may be exceeded and plastic deformation exerts another force, similar to the tensile force effect described on the doors described above.

All these iterative cyclic forces exerted on the waste effectively help it to create a universal distribution of waste density, resulting in a tightly compacted cuboid shaped filled bag with all voids fully filled. In other words the bag B (FIBC) internal forces are resolved and the contained waste has achieved a settled state of equilibrium.

Automatic Control with Sensors

In one embodiment the apparatus has a programmed controller linked with sensors to further contribute to the operation with pressure distribution and release. The sensors may include one or more selected from:

- Sensors to detect ram force or pressure to compact the waste, whether horizontal or vertical. These may be of the conventional type incorporated in hydraulic circuits, such as piezoelectric transducers.
- Motion sensors to detect extent of deflection of one or more enclosure panels. Examples are accelerometers or strain gauges.
- One or more sensors to detect the extent of bulging of a bag flexible wall at an open side of the enclosure. Examples are optical sensors or proximity switches or micro-switches, as are well known in the art.
- Proximity sensors to detect travel of the press or its actuator ram.

The controller is programmed to utilize the flexibility of the enclosure to avail of cyclical pressure sequences. When the compaction force is applied by the press, the material reaction transfers a portion of this compaction force to the enclosure walls to deflect and expand the containment volume. It also creates a surface which is now no longer vertical, and which in turn results in a drop in the compaction energy required to move the waste into the extra space created. This is because a lateral component of the compaction force that moves the waste against the panel is no longer perpendicular to the surface, but is now at an angle to the wall and effectively slides the material/waste up into the extra volume. This is geometrically more efficient.

This will result in a drop in energy required to move and compact the material, because the material is no longer restricted and therefore yields and enters the extra volume created.

This allows the controller to stagger the force applied to reduce power consumption and to achieve more efficient filling of the bag volume. The hydraulic system is not at maximum load, but rather incremental in the hydraulic cycle. The system requires less energy because it utilizes the staggered pressure to reach capacity.

Hence, if the controller senses that the applied force is near a maximum and/or the extent of panel deflection exceeds a threshold, and/or the extent of bulging of the bag exposed flexible wall reaches a threshold it can reduce the next stroke and/or reduce the hydraulic pressure to hence reduce the compacting press force. This will cause the compaction to be more efficient as less power is consumed. The extent of travel may be limited by a physical axial dimension or by a time limit of travel. This may achieve better distribution of waste as described with reference to the drawings.

The material resistance allows the pressure to build up within the hydraulic system and the enclosure wall flexes resulting in a sudden movement and yielding of the material. This will amplify the ram compaction capability. As the material moves and yields, for a period, the ram is still pushing at maximum pressure. However the material does not require the pressure to move and as a result the pressure required drops, but the speed in the hydraulic system will increase, moving and compacting the material quicker and more efficiently (the ram cycle time will reduce).

Figure 36:
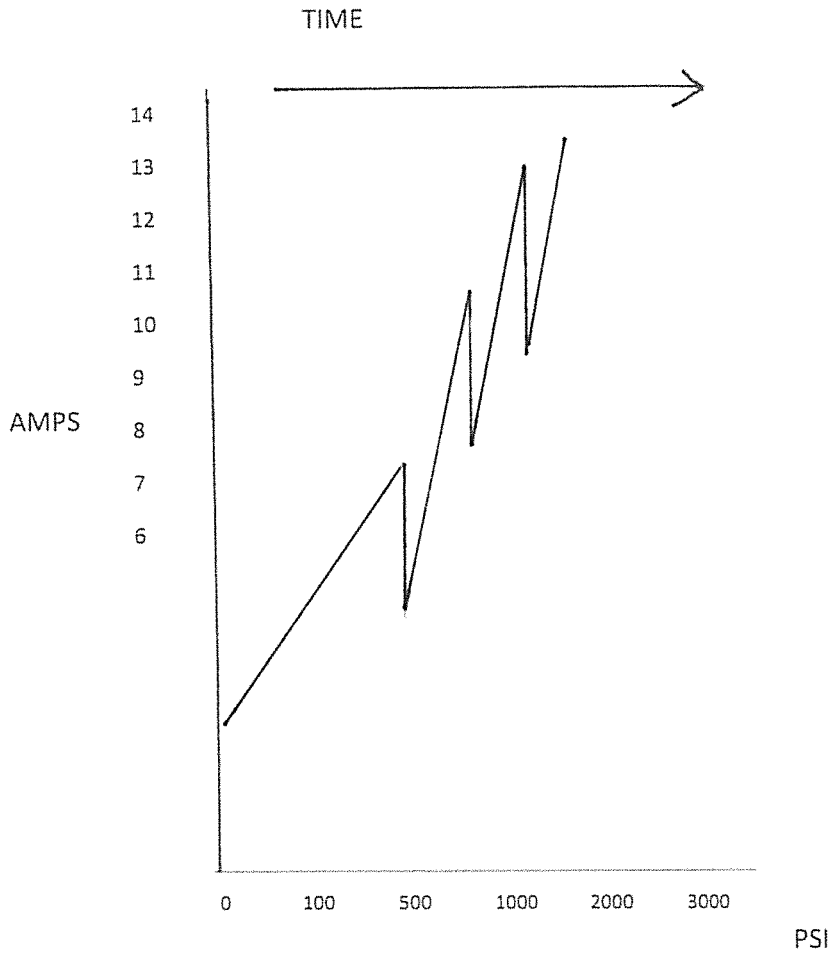
FIG. 36 is a plot of energy vs. pressure of a compactor of the invention.

FIG. 36 is an energy vs. pressure graph showing the pressure lagging the power supplied, to demonstrate that the amount of energy required to move material is less when compared to a prior art static container because the resilient enclosure facilitates greater movement of material.

The cycle of yield and unyielding material also introduces varying pressure and reactive waves as described above. The amplitude and magnitude can vary inside a cycle resulting in variable frequency and varying pressure compaction.

The controller may be linked with sensors to detect physical deflection of the enclosure panels in both the outward and inward directions. The deflection sensors provide valuable data to the controller in addition to that from sensors providing data representing pressure, power and time. The controller preferably uses a real time clock to measure the time for deflection to certain thresholds to occur, indicating the speed of flexure. The deflection monitoring is preferably in all three axes, (X, Y, Z).

A further element of control is introduced in the accuracy of the pressure feed-back, the system compresses with no shear forces as the force applied is axial. An example of a device used to measure deflection is an accelerometer or a proximity sensor to measure protrusion/level. The combination of measurable items and detectable parameters allow for an extremely sensitive and highly accurate and advanced control and feed-back system. The operational and feed-back parameters can be adjusted in real time to optimize the compression/compaction sequence. For example if the rate of deflection and/or the extent of deflection is above a threshold, the controller can reduce the force applied to the press.

The behavioral characteristics of waste for compaction, i.e. pressure, penetration, flexural and time tolerances can be recorded and the data used to create a profile for an optimized bandwidth of operation. Also, the profile parameters of operation can be altered to optimize the compaction of different waste streams.

The controller may not only be used to provide real-time data, but also the sensors allow for an accurate model of the compaction process. This information can be stored and updated after each compaction cycle. For example, during a compaction cycle, if the rate of deflection and/or the extent of deflection is above or below a threshold, the controller can change the force applied to the press and/or change the stroke length or the time variables to create additional volume or compaction force. The system can dynamically respond, effectively customizing each compaction cycle (adapting/responding to each cycle's requirements).

For example, it would be assumed that the material added during the first cycle would not register deflections in the containment unit. It would also be assumed that once deflection is monitored it would be axial. It would also be assumed that the degree of axial deflection would be representative of material occupying available volume prior to lateral deflection.

Such stored data can assist the controller to detect more quickly if there is a blockage or an obstruction in the compactor. The controller is not relying on just pressure and time to determine the next course of action. The controller contains operational characteristics and a record of the data gathered from previous compaction cycle and when applying pressure, has an accurate model from the previous cycle to compare against to help prevent potentially damage or compounding a blockage problem.

The system can use this comparative data to determine the next step, an example scenario, in the event of a blockage, would be to increase the pressure and monitor deflection vs. time, or monitor power vs. time vs. deflection, or stroke penetration vs. pressure vs. deflection or a combination. The results of which will relay more accurate information as to the status of the compactor/invention.

The invention is not limited to the embodiments described but may be varied in construction and detail. For example, the invention may be applied to a compactor for material other than domestic waste such as industrial waste or production material such as carpet remnants. Also, the invention may be applied to material storage such as materials kept under compaction/pressure to reduce volume or to provide structure in the transport of viscus/liquid material. The enclosure for the bag may take any form other than a cage, such as for example having walls without openings. The actuator may extend laterally rather than vertically, in which case the cage or other enclosure is facing in this lateral direction.

The invention claimed is:

1. A compactor comprising:

a compacting press driven by an actuator to press material into a bag, the compacting press having an inlet for receipt of the material, the actuator acting along a longitudinal axis, and in repeated cycles of both press and return strokes an enclosure to contain the bag during material compaction, the enclosure being positioned downstream from the inlet of the compacting press, wherein the enclosure includes:

a transverse panel configured to support the bag and being parallel to said longitudinal axis, an open side facing the actuator and an additional open side parallel to the longitudinal axis and being opposed to said transverse panel, a pair of opposed resilient side panels extending substantially in the axial direction on opposed sides of said longitudinal axis, each said opposed resilient side panels being connected to the transverse panel to form a corner by an edge of the side panel being fixed and joined to an edge of the transverse panel whereby each said side panel deflects about said side panel fixed edge, at least one distal panel extending in a plane across the longitudinal axis, said distal panel or panels forming a distal wall of the enclosure, and wherein the or each distal panel is hinged to a side panel and opens to allow removal of a filled bag.

2. The compactor as claimed in claim 1, wherein the actuator includes parallel opposed rams.

3. The compactor as claimed in claim 1, wherein the actuator includes parallel opposed rams; a support frame having a stem parallel to the rams, and a cross-piece at each end of the stem, each cross piece engaging at least one ram and at least some of the cross-pieces being mutually orthogonal.

4. The compactor as claimed in claim 1, wherein the actuator includes parallel opposed rams; a support frame having a stem parallel to the rams, and a cross-piece at each end of the stem, each cross piece engaging at least one ram and at least some of the cross-pieces being mutually orthogonal; and wherein each cross piece engages two rams, and each cross-piece engages at least one ram cylinder.

5. The compactor as claimed in claim 1, wherein there are two distal panels, each said distal panel being hinged to a side panel and being arranged to be releasably engaged with the other distal panel.

6. The compactor as claimed in claim 1, further comprising a controller and at least one sensor arranged to detect a parameter of physical movement of the enclosure or the bag, and the controller is configured to dynamically adjust parameters for applying power to the compacting press in response to said detected parameter values.

7. The compactor as claimed in claim 1, further comprising a controller and at least one sensor arranged to detect a parameter of physical movement of the enclosure or a bag, and the controller is configured to dynamically adjust parameters for applying power to the compacting press in response to said detected parameter values, and wherein the enclosure includes panels mounted to deflect about an axis and sensors arranged to detect extent of deflection about the axis.

8. The compactor as claimed in claim 1, further comprising a controller and at least one sensor arranged to detect a parameter of physical movement of the enclosure or a bag, and the controller is configured to dynamically adjust parameters for applying power to the compacting press in response to said detected parameter values, and wherein the controller is configured to dynamically reduce compacting press stroke length and/or applied pressure in response to sensing of panel deflection above a threshold.

9. The compactor as claimed in claim 1, further comprising a controller and at least one sensor arranged to detect a parameter of physical movement of the enclosure or a bag, and the controller is configured to dynamically adjust parameters for applying power to the compacting press in response to said detected parameter values, and wherein the enclosure is open on at least one side and the at least one sensor includes a sensor to detect extent of bulging of an exposed flexible wall of a bag, and the controller is configured to reduce compacting press stroke length and/or applied pressure in response to detection of said bulging above a threshold.

10. The compactor as claimed in claim 1, further comprising a controller and at least one sensor arranged to detect a parameter of physical movement of the enclosure or a bag, and the controller is configured to dynamically adjust parameters for applying power to the compacting press in response to said detected parameter values, and wherein the controller is configured to store said parameter values or meta data derived from said values to generate a model for filling of an enclosure, and to refer to said model for real time control in the future.

* * * * *